US011401650B2

(12) United States Patent
Lee et al.

(10) Patent No.: US 11,401,650 B2
(45) Date of Patent: Aug. 2, 2022

(54) TUB FOR WASHING MACHINE AND WASHING MACHINE HAVING THE SAME

(71) Applicant: LG Electronics Inc., Seoul (KR)

(72) Inventors: Hyunseung Lee, Seoul (KR); Sanghee Yoo, Seoul (KR); Cheolmin Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 326 days.

(21) Appl. No.: 16/684,218

(22) Filed: Nov. 14, 2019

(65) Prior Publication Data

US 2020/0149210 A1 May 14, 2020

(30) Foreign Application Priority Data

Nov. 14, 2018 (KR) ..... 10-2018-0140072

(51) Int. Cl.
*D06F 39/12* (2006.01)
*D06F 39/08* (2006.01)

(52) U.S. Cl.
CPC ..... *D06F 39/12* (2013.01); *D06F 39/083* (2013.01)

(58) Field of Classification Search
CPC ..... D06F 37/263; D06F 39/083; D06F 39/12; D06F 37/26; D06F 37/261; B29C 66/54; B29C 66/542; B29C 66/232
(Continued)

(56) References Cited

U.S. PATENT DOCUMENTS 4,423,607 A * 1/1984 Munini ..... D06F 37/20 220/675
5,433,091 A * 7/1995 Durazzani ..... D06F 37/04 34/602

(Continued)

FOREIGN PATENT DOCUMENTS

DE 102007056425 5/2009
DE 102013113391 6/2015

(Continued)

OTHER PUBLICATIONS

Juckemoller; Frank, "Plastic tub for washing machines and washer-drier", Jun. 2015, DE 102013113391A1—Machine Translation (Year: 2015).*

(Continued)

*Primary Examiner* — Michael E Barr
*Assistant Examiner* — Thomas Bucci
(74) *Attorney, Agent, or Firm* — Fish & Richardson P.C.

(57) ABSTRACT

A tub of a washing machine includes: a first case and a second case welded to each other; a first coupling surface formed along a circumference of the first case facing the second case; a second coupling surface formed along a circumference of the second case facing the first case and bonded to the first coupling surface; and a coupling protrusion that protrudes along the first coupling surface and includes a protruding end portion welded to the second coupling surface. The coupling protrusion includes: a main coupling protrusion protruding along the first coupling surface; and an auxiliary coupling protrusion protruding along the first coupling surface and outwardly spaced apart from the main coupling protrusion. Further, an opening for communicating a space between the auxiliary coupling protrusion and the main coupling protrusion to an outside of the tub is defined in a bottom of the tub.

19 Claims, 12 Drawing Sheets

(58) Field of Classification Search
USPC ..... 68/208
See application file for complete search history.

(56) References Cited

U.S. PATENT DOCUMENTS

| | | | | |
|---|---|---|---|---|
| 6,681,602 | B2 * | 1/2004 | Heyder | D06F 37/262 68/140 |
| 7,971,456 | B2 * | 7/2011 | Kim | D06F 37/262 68/140 |
| 8,047,025 | B2 * | 11/2011 | Borque Marquina | B29C 66/322 68/142 |
| 2004/0123633 | A1 * | 7/2004 | Jo | D06F 37/264 68/3 R |
| 2004/0148981 | A1 * | 8/2004 | Kim | D06F 37/263 68/24 |
| 2005/0005652 | A1 * | 1/2005 | Park | D06F 37/264 68/24 |
| 2006/0081014 | A1 * | 4/2006 | Choi | D06F 39/081 68/3 R |
| 2007/0113597 | A1 * | 5/2007 | Kim | B29C 65/0618 68/140 |
| 2007/0175245 | A1 * | 8/2007 | Kim | D06F 37/264 264/328.1 |
| 2007/0285261 | A1 * | 12/2007 | Lee | D06F 39/081 340/623 |
| 2008/0276658 | A1 * | 11/2008 | Gweon | D06F 37/263 68/208 |
| 2009/0165506 | A1 * | 7/2009 | Marquina | B29C 66/12469 68/142 |
| 2011/0023557 | A1 * | 2/2011 | Borque Marquina | D06F 37/262 68/142 |
| 2011/0285260 | A1 * | 11/2011 | Moon | D06F 37/264 312/228 |
| 2011/0289756 | A1 * | 12/2011 | Zanello | B29C 66/12441 29/33 R |
| 2015/0345066 | A1 * | 12/2015 | Bigelow | D06F 37/04 156/60 |
| 2016/0186371 | A1 * | 6/2016 | Cinello | D06F 37/267 68/208 |
| 2018/0038035 | A1 * | 2/2018 | Bigelow | D06F 37/263 |
| 2020/0149211 | A1 * | 5/2020 | Lee | D06F 39/12 |

FOREIGN PATENT DOCUMENTS

| | | | | |
|---|---|---|---|---|
| DE | 102013113391 | A1 * | 6/2015 | D06F 37/262 |
| EP | 2631346 | | 8/2013 | |
| EP | 2865800 | | 4/2015 | |
| EP | 2865800 | A1 * | 4/2015 | B29C 65/0618 |
| KR | 1020060089786 | | 8/2006 | |

OTHER PUBLICATIONS

Extended European Search Report in European Appln. No. 19207095.1, dated Mar. 23, 2020, 10 pages.

* cited by examiner

TUB FOR WASHING MACHINE AND WASHING MACHINE HAVING THE SAME

CROSS-REFERENCE TO RELATED APPLICATION

This application is based on and claims the benefit of priority to Korean Patent Application No. 10-2018-0140072, filed on Nov. 14, 2018, in the Korean Intellectual Property Office, the disclosure of which is incorporated herein in its entirety by reference.

BACKGROUND OF THE DISCLOSURE

Field of the Disclosure

The present disclosure relates to a tub for a washing machine and a washing machine having the same.

Discussion of the Related Art

In general, a washing machine is a home appliance for removing contaminants on clothes, bedding, or the like (hereinafter referred to as laundry) through processes such as washing, rinsing, dehydrating, drying, and the like, using water, detergent, a mechanical action, and the like.

Such washing machine may include a cabinet forming an outer shape of the washing machine, a tub installed inside the cabinet, a drum rotatably installed inside the tub and having a plurality of through-holes through which washing water or foam flows in and out, and a motor installed in the tub to rotate the drum. A rotation shaft of the motor may pass through one side of the tub to be connected to the drum.

The tub may define a washing space therein for receiving the drum, and may be opened toward an entrance for inserting and removing the laundry of the washing machine to define a passage through which the laundry is introduced into the drum.

When the washing machine is operated for washing the laundry, washing water for the washing is supplied into the tub. When the washing water is sufficiently filled in the tub, the drum is rotated by the motor. When the drum is rotated, the washing water inside the tub flows into and flows out of the drum through the plurality of through-holes defined in the drum, and the washing of the laundry received inside the drum is performed.

When the washing is completed, a drain pump disposed in the washing machine is operated, thereby discharging the washing water inside the tub.

In one example, an outer shape of the tub may be formed by a combination of a plurality of divided components. That is, the tub may be produced in a state in which the drum is received therein by the combination of the plurality of divided components. Each of the divided plurality of components of the tub may form a portion of the washing space of the tub.

For example, the tub may be formed in a substantially cylindrical shape. Further, the tub may include a first case for forming a half of the cylindrical shape and a second case to form the other half.

Conventionally, a coupling structure in which a gasket for sealing is provided on a contact face of the first case and the second case, and the first case and the second case are coupled with each other by a fastening member such as a bolt has been applied.

Korean Patent Application Publication No. 10-2006-0089786, which is a prior document, discloses a structure in which an outer shape of a tub 58 of a washing machine is formed by a combination of a tub cover 90 and a tub main body 92.

According to the prior document, the tub cover 90 forms a front portion of the tub 58 and the tub main body 92 forms a rear portion of the tub 58. Holes are defined in the tub cover 90 and the tub main body 92 along outer circumferences thereof, and fastening members 94 are coupled into the holes, thereby connecting the tub cover 90 and the tub main body 92 with each other.

However, when the first case and the second case, which form the tub, are coupled to each other by the fastening member as in the prior art, after the gasket is disposed between the first case and the second case, the fastening members must be fastened to the plurality of holes defined along the outer circumferences of the first case and the second case.

Therefore, work man-hour for assembly of the tub is increased to cause increase of production time of the washing machine.

In addition, due to the increase in the number of components such as the gaskets and the fastening members, misassembly of the tub may occur easily, resulting in increased component costs.

In addition, when a fastening force of the fastening member is lowered or the gasket is aged, leakage of the washing water between the first case and the second case may occur.

SUMMARY OF THE DISCLOSURE

The present embodiment provides a tub of a washing machine and a washing machine including the same in which an outer appearance of the tub of the washing machine may be formed by coupling of a first case and a second case, and the first case and the second case may be easily coupled to each other by a welding process.

The present embodiment provides a tub of a washing machine and a washing machine including the same in which a first case and a second case may be stably welded to each other by a welding process to prevent leakage of water.

The present embodiment provides a tub of a washing machine and a washing machine including the same in which flash generated during welding of a first case and a second case is prevented from flowing into the tub.

The present embodiment provides a tub of a washing machine and a washing machine including the same in which a coupling protrusion for welding of a first case and a second case includes a main coupling protrusion and an auxiliary coupling protrusion outward of the main coupling protrusion, and washing water leaked into a space between the main coupling protrusion and the auxiliary coupling protrusion is capable of being discharged to outside.

In a first aspect of the present disclosure, there is provided a tub for a washing machine, wherein the tub has a washing space defined therein and filled with washing water, wherein a drum for receiving laundry therein is rotatably disposed in the washing space. The tub includes: a first case and a second case welded to be coupled to each other to form the washing space and an outer appearance of the tub; a first coupling surface formed along a circumference of the first case facing the second case; a second coupling surface formed along a circumference of the second case facing the first case and bonded to the first coupling surface; and a coupling protrusion protruding along the first coupling surface to encircle the washing space, wherein a protruding end portion of the coupling protrusion is welded to the second coupling surface, wherein the coupling protrusion includes: a main coupling protrusion protruding along the first coupling surface; and an auxiliary coupling protrusion protruding along the first coupling surface and outwardly spaced apart from the main coupling protrusion, wherein an opening for communicating a space between the auxiliary coupling protrusion and the main coupling protrusion to an outside of the tub is defined in a bottom of the tub.

In one implementation, the opening may be defined at a position vertically lower than a height corresponding to a limiting level (H) of the washing water filled in the washing space.

In one implementation, the opening may be defined in the first coupling surface positioned between the main coupling protrusion and the auxiliary coupling protrusion at the bottom of the tub.

In one implementation, the opening may be defined in the second coupling surface positioned between the main coupling protrusion and the auxiliary coupling protrusion at the bottom of the tub.

In one implementation, a portion of the auxiliary coupling protrusion located at the bottom of the tub may be cut to define the opening.

In one implementation, a water collecting portion recessed downward for collecting the washing water supplied into the tub may be formed at the bottom of the tub, and a bottom face of the water collecting portion may be formed in a planar shape.

In one implementation, the first coupling surface positioned below the water collecting portion may have a lower-side straight portion formed thereon, the lower-side straight portion being configured to extend in a widthwise direction of the water collecting portion which is perpendicular to an axial direction of the tub, and the main coupling protrusion and the auxiliary coupling protrusion may be formed on the lower-side straight portion in a straight-line shape in the widthwise direction of the water collecting portion.

In one implementation, the opening may be defined at a central position of the auxiliary coupling protrusion formed on the lower-side straight portion.

In one implementation, the opening may be defined at a position biased in the widthwise direction of the water collection portion from a central position of the auxiliary coupling protrusion formed on the lower-side straight portion.

In one implementation, the opening is defined in at least one of left and right ends of the auxiliary coupling protrusions formed on the lower-side straight portion.

In one implementation, the coupling protrusion may include a plurality of connection ribs for connecting the main coupling protrusion and the auxiliary coupling protrusion in the space between the main coupling protrusion and the auxiliary coupling protrusion, wherein the plurality of connection ribs may be spaced apart from each other along the space between the main coupling protrusion and the auxiliary coupling protrusion.

In one implementation, the connection ribs may be formed at a height less than a height of the coupling protrusion in a state where the welding is completed.

In one implementation, the auxiliary coupling protrusion may have a radial thickness smaller than a radial thickness of the main coupling protrusion.

In one implementation, one of the first case and the second case forms a front portion of the tub and the other forms a rear portion of the tub.

In one implementation, the first coupling surface may extend outward of the circumference of the first case, and the second coupling surface may extend outward of the circumference of the second case.

In one implementation, the tub may further include a constraining protrusion protruding along the second coupling surface, the constraining protrusion being configured to constrain flash generated during the welding of the coupling protrusion in a space between the first coupling surface and the second coupling surface, and the constraining protrusion may be formed in at least one of a region of the second coupling surface located inward than the main coupling protrusion and a region of the second coupling surface located outward than the auxiliary coupling protrusion.

In one implementation, the constraining protrusion may be only formed in a region of the second coupling surface located inward than the main coupling protrusion.

In one implementation, the constraining protrusion may be located inwardly of the main coupling protrusion and may be spaced apart from the coupling protrusion.

In one implementation, the tub may further include guide protrusions formed at both sides of the second coupling surface, which face each other with respect to an internal space of the second case to guide the coupling protrusion towards the second coupling surface defined outside the constraining protrusion, and wherein the guide protrusion may have a slanted face declined outwardly.

In a first aspect of the present disclosure, there is provided a washing machine including: a cabinet having a space defined therein; a tub disposed in the cabinet to define a washing space filled with washing water; and a drum rotatably disposed inside the tub for receiving laundry therein, wherein the tub includes: a first case and a second case welded to be coupled to each other to form the washing space and an outer appearance of the tub; a first coupling surface formed along a circumference of the first case facing the second case; a second coupling surface formed along a circumference of the second case facing the first case and bonded to the first coupling surface; and a coupling protrusion protruding along the first coupling surface to encircle the washing space, wherein a protruding end portion of the coupling protrusion is welded to the second coupling surface, wherein the coupling protrusion includes: a main coupling protrusion protruding along the first coupling surface; and an auxiliary coupling protrusion protruding along the first coupling surface and outwardly spaced apart from the main coupling protrusion, wherein an opening for communicating a space between the auxiliary coupling protrusion and the main coupling protrusion to an outside of the tub is defined in a bottom of the tub.

In one implementation, the opening may be defined at a position vertically lower than a height corresponding to a limiting level (H) of the washing water filled in the washing space.

In one implementation, the opening may be defined in the first coupling surface positioned between the main coupling protrusion and the auxiliary coupling protrusion at the bottom of the tub.

In one implementation, the opening may be defined in the second coupling surface positioned between the main coupling protrusion and the auxiliary coupling protrusion at the bottom of the tub.

In one implementation, a portion of the auxiliary coupling portion located at the bottom of the tub may be cut to define the opening.

In one implementation, a water collecting portion recessed downward for collecting the washing water supplied into the tub may be formed at the bottom of the tub, and a bottom face of the water collecting portion may be formed in a planar shape.

In one implementation, the first coupling surface positioned below the water collecting portion may have a lower-side straight portion formed thereon, the lower-side straight portion being configure to extend in a widthwise direction of the water collecting portion which is perpendicular to an axial direction of the tub, and the main coupling protrusion and the auxiliary coupling protrusion may be formed on the lower-side straight portion in a straight-line shape in the widthwise direction of the water collecting portion.

In one implementation, the opening may be defined at a central position of the auxiliary coupling protrusion formed on the lower-side straight portion.

In one implementation, the opening may be defined at a position biased in the widthwise direction of the water collecting portion from a central position of the auxiliary coupling protrusion formed on the lower-side straight portion.

In one implementation, the opening is defined in at least one of left and right ends of the auxiliary coupling protrusions formed on the lower-side straight portion.

In one implementation, the coupling protrusion may include a plurality of connection ribs for connecting the main coupling protrusion and the auxiliary coupling protrusion in the space between the main coupling protrusion and the auxiliary coupling protrusion, wherein the plurality of connection ribs may be spaced apart from each other along the space between the main coupling protrusion and the auxiliary coupling protrusion, and wherein the plurality of connection ribs may have a height less than a height of the coupling protrusion in a state where the welding is completed.

In one implementation, the auxiliary coupling protrusion may be formed to have a radial thickness less than a radial thickness of the main coupling protrusion.

In one implementation, one of the first case and the second case may form a front portion of the tub and the other may form a rear portion of the tub.

In one implementation, the first coupling surface may extend outward of the circumference of the first case, and the second coupling surface may extend outward of the circumference of the second case.

In one implementation, the tub may further include a constraining protrusion protruding along the second coupling surface, the constraining protrusion being configured to constrain flash generated during the welding of the coupling protrusion in a space between the first coupling surface and the second coupling surface, and the constraining protrusion may be formed in at least one of a region of the second coupling surface located inward than the main coupling protrusion and a region of the second coupling surface located outward than the auxiliary coupling protrusion.

In one implementation, the tub may further include guide protrusions formed at both sides of the second coupling surface, which face each other with respect to an internal space of the second case to guide the coupling protrusion towards the second coupling surface define outside the constraining protrusion, and the guide protrusion may have a slanted face declined outwardly.

Further, the washing machine may further include: a base forming a bottom surface of the cabinet; a leakage detecting sensor disposed on the base for detecting leakage when the washing water is in contact therewith; an output device disposed on the cabinet for outputting information; and a controller that receives a leakage signal from the leakage detecting sensor; and outputs an alarm through the output device when the leakage occurs.

In one implementation, the leakage detecting sensor may be provided on the bottom surface of the base, and the bottom face of the base may be inclined downwardly toward the leakage detecting sensor.

In one implementation, the washing machine may further include a guide member extending from the opening toward the leakage detecting sensor, wherein the guide member guides the washing water discharged through the opening to the leakage detecting sensor.

DESCRIPTION OF SPECIFIC EMBODIMENTS

Figure 1:
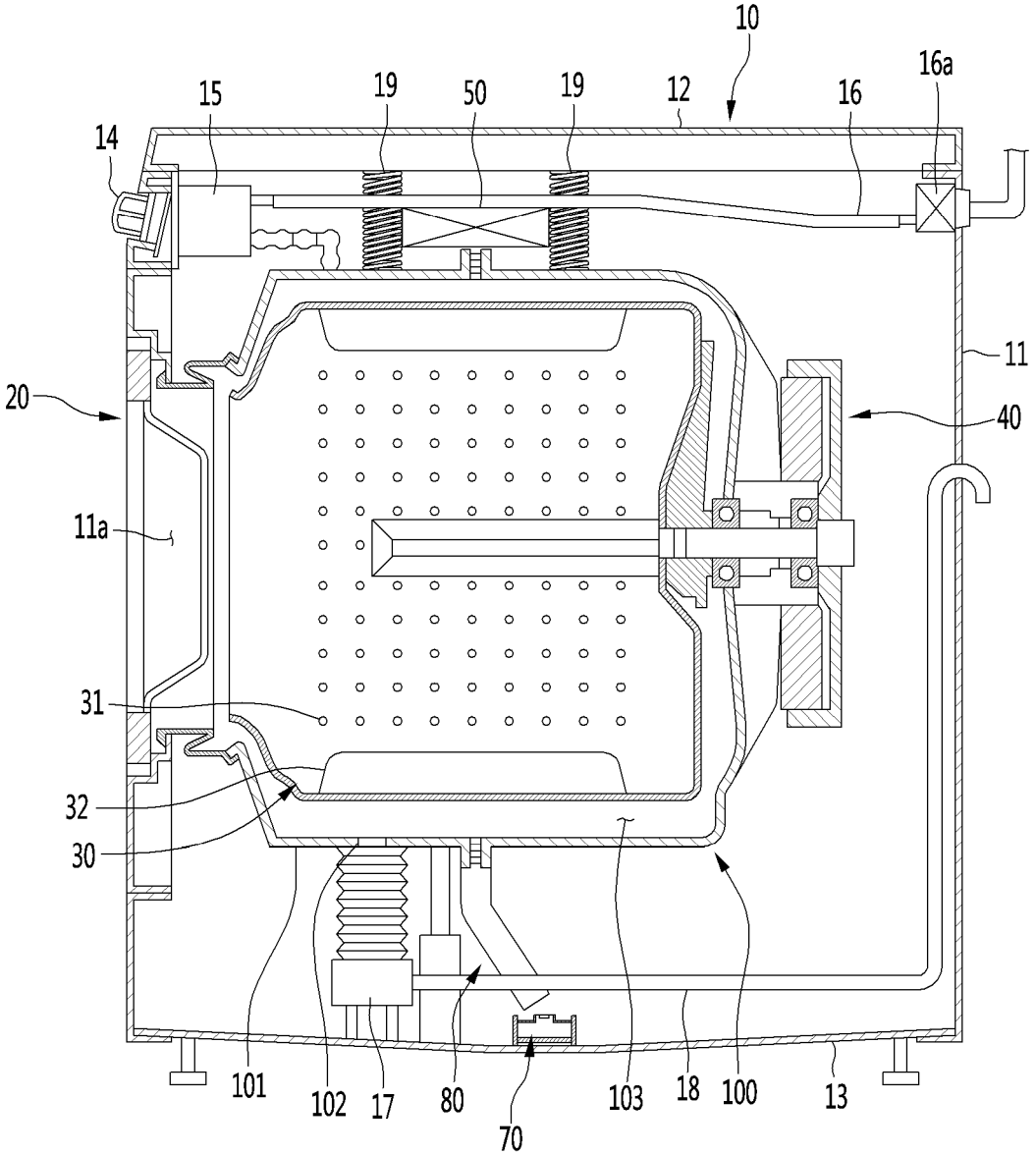
FIG. 1 is a cross-sectional view illustrating an internal configuration of a washing machine according to an embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
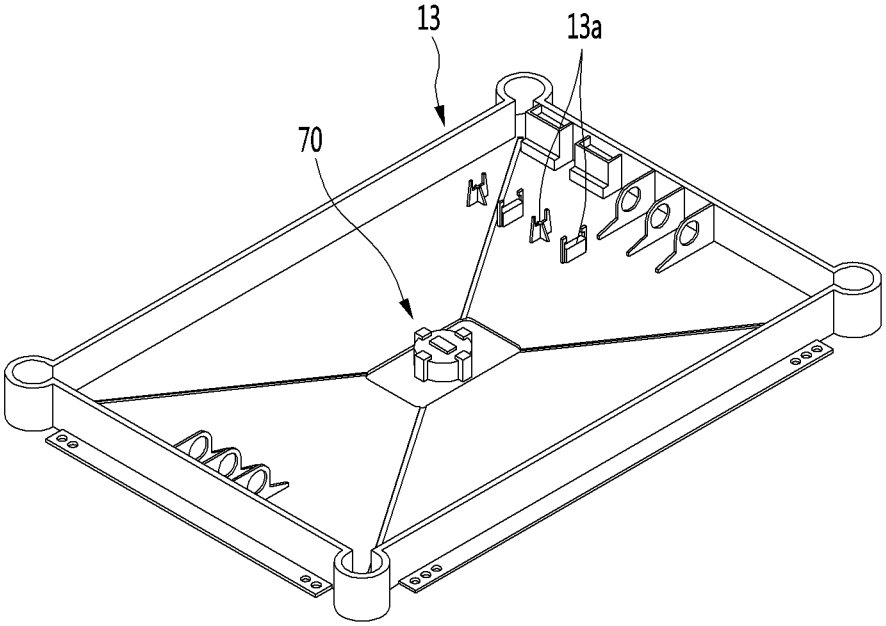
FIG. 2 is a perspective view of a base fan according to an embodiment of the present disclosure.
Figure 3:
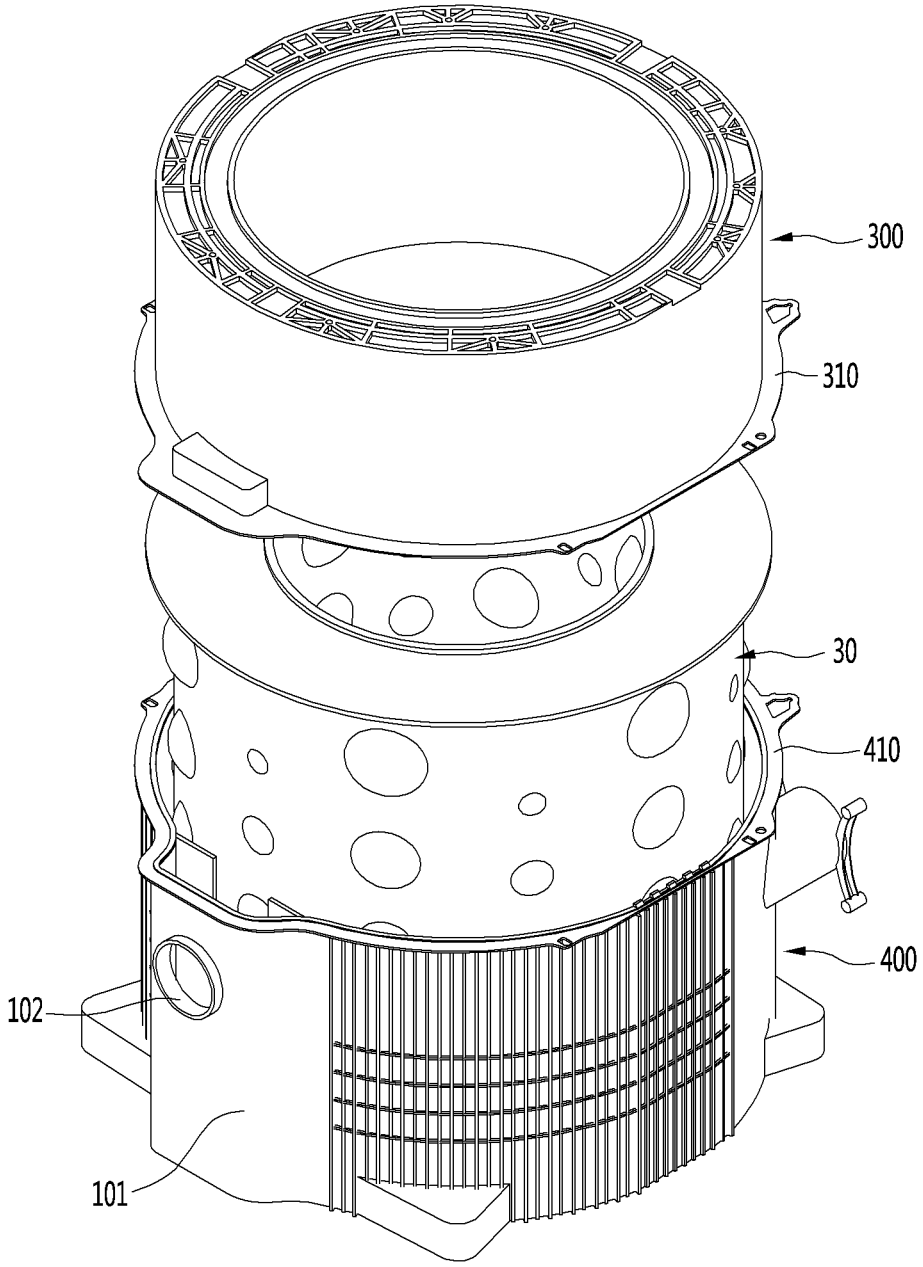
FIG. 3 is a view illustrating a state in which a tub is disassembled according to an embodiment of the present disclosure.

FIG. 1 is a cross-sectional view illustrating an internal configuration of a washing machine according to an embodiment of the present disclosure. Further, FIG. 2 is a perspective view of a base fan according to an embodiment of the present disclosure. Further, FIG. 3 is a view illustrating a state in which a tub is disassembled according to an embodiment of the present disclosure.

A tub 100 according to an embodiment of the present disclosure may be applied to a general washing machine having a drum with a vertical rotation shaft, or may be applied to a drum washing machine 1 having a horizontal rotation shaft.

Hereinafter, it will be described that the tub 100 is disposed in the drum washing machine 1, as an example.

An outer appearance of the drum washing machine 1 may be formed by a main body 10 and a door 20.

A space may be defined inside the main body 10. The outer appearance of the main body 10 may be formed by a cabinet 11, a top cover 12, and a base fan 13.

In detail, the cabinet 11 may be formed in a box shape with open top surface and bottom face. The cabinet 11 may form a peripheral surface of the main body 10.

An entrance 11*a* through which the laundry passes may be defined in a front surface of the cabinet 11.

The top cover 12 may be mounted on a top surface of the cabinet 11 to form a top surface of the main body 10. That is, the top cover 12 may be provided to cover the top surface of the cabinet 11.

The base fan 13 may be mounted on a bottom surface of the cabinet 11 to form a bottom surface of the main body 10. That is, the base fan 13 may be provided to cover the bottom surface of the cabinet 11.

The base fan 13 may have a bottom surface that covers the bottom surface of the cabinet 11 and edges protruding along a perimeter of the bottom surface.

The edges of the base fan 13 may be coupled to the cabinet 11 in a state overlapping with a lower peripheral surface of the cabinet 11.

In one example, the base fan 13 may have electric parts mounting portions 13*a* on which electric parts are mounted. The electrical parts may include a drain pump 17 to be described later.

The electric parts mounting portions 13*a* may protrude from the bottom surface of the base fan 13 to allow the mounted electric parts to be spaced apart from the bottom surface of the base fan 13. In this connection, the electric parts mounting portions 13*a* may be applied in various sizes and shapes corresponding to types and shapes of the electric parts to be mounted.

The electric parts mounted on the electric parts mounting portions 13*a* are spaced apart from the bottom surface of the base fan 13, so that the electric parts may not be come into contact with water and protected even when water leaks inside the main body 10.

In detail, in components in the main body 10 where washing water flows, leakage of the washing water may occur due to poor assembly or defective products.

For example, the leakage of the washing water may occur in the tub 100, the water supply pipe 16, the water discharge pipe 18, or the like. When the washing water leaks, the leaked washing water may be collected in the base fan 13. In this connection, when the electric parts mounted on the base fan 13 are located on the bottom surface of the base fan 13, failure may occur due to the washing water.

However, the electric parts are mounted on the electric parts mounting portions 13*a* and spaced apart from the bottom surface of the base fan 13, so that contact with the leaked washing water may be prevented.

In one example, the base fan 13 may have a leakage detecting sensor 70 for detecting the occurrence of the leakage. The leakage detecting sensor 70 may be provided on the bottom surface of the base fan 13.

In this connection, the bottom surface of the base fan 13 may be inclined downward toward a position where the leakage detecting sensor 70 is provided. For example, the leakage detecting sensor 70 may be located approximately at a center of the base fan 13. The bottom surface of the base fan 13 may be inclined downward toward the center. Therefore, the water collected in the base fan 13 may be moved toward the leakage detecting sensor 70, and the leakage may be detected quickly.

The leakage detecting sensor 70 may include various sensors capable of detecting the contact with water.

In one example, the drum washing machine 1 may include a controller for controlling overall operations. The leakage detecting sensor 70 may be connected to the controller and may output a detection signal to the controller when the leakage is detected.

The drum washing machine 1 may have an output device electrically connected to the controller for outputting an operation state of the drum washing machine 1.

The output device may be a speaker for outputting sound. Alternatively, the output device may be a display for outputting texts or pictures.

The speaker and the display may be provided in the main body 10. For example, the display may be provided on an upper portion of the front face of the main body 10. Both or only one of the speaker and the display may be provided.

When the leakage is detected by the leakage detecting sensor 70, the controller may output a specific alarm through the output device to allow a user to recognize an abnormal state of the product. Therefore, the user may recognize the occurrence of the leakage via the alarm, and may respond such as stopping use of the product, repair, or the like.

In one example, a manipulation unit 14 for manipulating the operation of the drum washing machine 1 may be disposed on the upper portion of the front surface. The manipulation unit 14 may be electrically connected to the controller to transmit a command input by the user to the controller.

A detergent box 15 that is retractable into and extendable out of the main body 10 may be provided at the upper portion of the front surface of the main body 10. The user may inject detergent into the detergent box 15 by extending the detergent box 15.

The main body 10 may include a water supply pipe 16 for supplying the washing water into the tub 100. The water supply pipe 16 may be connected to an external water supply source and pass through one side of the main body 10 to extend inside the main body 10.

The water supply pipe 16 may be connected to the tub 100 via the detergent box 15 to allow the detergent injected into the detergent box 15 to be supplied to the tub 100 together with the washing water.

The drain pump 17 and the water discharge pipe 18 for circulating or discharging the washing water may be arranged inside the main body 10 and below the tub 100.

The drain pump 17 may be mounted on the electric parts mounting portion 13*a* of the base fan 13.

The water discharge pipe 18 may be connected to one side of the bottom face of the tub 100 and extend out of the main body 10. The drain pump 17 may be connected to one side of the water discharge pipe 18 to force drainage of the washing water.

The door 20 may be pivotably provided on the front surface of the main body 10. The door 20 may be provided to open and close the entrance 11*a* by pivoting.

In one example, the drum washing machine 1 may include the tub 100 installed inside the main body 10, the drum 30 rotatably installed in the tub 100, wherein the washing of the laundry is performed in the drum 30, and the motor 40 mounted on the tub 100 to rotate the drum 30.

The tub 100 may be formed in a substantially cylindrical shape, and may define therein a washing space 103 filled with the washing water. The drum 30 may be received in the washing space 103 of the tub 100.

The tub 100 may be in a form of lying in the main body 10, and a front face thereof facing the entrance 11*a* may be opened.

The tub 100 may be suspended by a spring 19 in the main body 10.

A water collecting portion 101 for collecting the washing water therein may be formed in a lower portion of the tub 100. The water collecting portion 101 is formed in a structure in which a bottom face thereof inside the tub 100 is recessed downward, so that the washing water may be easily collected therein.

A water drain hole 102 through which the washing water is discharged and in communication with the water discharge pipe 18 may be defined in the water collecting portion 101.

The drum 30 is formed in a substantially cylindrical shape to define therein a space for receiving the laundry therein. In this connection, the drum 30 is formed to be smaller than the washing space 103 of the tub 100, so that an outer face of the drum 30 may be spaced apart from an inner face of the tub 100.

The drum 30 may be in a form of lying in the tub 100 and may be opened toward the entrance 11*a*. Therefore, the laundry may be inserted into and removed out of the drum 30 through the entrance 11*a*.

A plurality of holes 31 through which the washing water passes may be defined along a circumference of the drum 30. When the drum 30 is rotated, the washing water supplied into the tub 100 may be supplied into the drum 30 or discharged out of the drum 30 through the holes 31. That is, the washing water in the washing space 103 of the tub 100 may be circulated to the drum 30.

The motor 40 may be provided on a rear side of the tub 100. That is, the motor 40 may be provided out of a rear face of the tub 100 opposite to the opened front face of the tub 100. A rotation shaft of the motor 40 may pass through the rear face of the tub 100 and be connected to the drum 30.

In this connection, the rotation shaft of the motor 40 may be formed horizontally with the ground. That is, the drum 30 is rotated about the rotation shaft, which is horizontal to the ground, so that the laundry received therein may be moved upward and then dropped.

On an inner face of the drum 30, a lift 32 for lifting the laundry during the rotation of the drum 30 may be disposed. The lift 32 may be provided to protrude from an inner circumference of the drum 30. The lift 32 may include a plurality of lifts, and the plurality of lifts 32 may be spaced apart from each other along the inner circumference of the drum 30.

When the washing machine 1 is operated for the washing, the washing water may be supplied into the washing space 103 of the tub 100 through the water supply pipe 16. The washing water supplied into the tub 100 may be filled from a bottom of the tub 100.

The washing water filled in the tub 100 may be circulated into the drum 30 through the holes 31 of the drum 30.

When the washing water is sufficiently supplied into the tub 100, the motor 40 may be operated to rotate the drum 30. When the drum 30 is rotated, the laundry inside the drum 30 may be moved upward by the lift 32 and then be washed by the washing water while falling.

When the washing is completed, the motor 40 may be stopped, and the drain pump 17 may be operated. When the drain pump 17 is operated, the washing water inside the tub 100 may be discharged to the outside through the water drain hole 102 and the water discharge pipe 18.

In one example, an outer appearance of the tub 100 may be formed by coupling of a plurality of divided components. That is, the tub 100 may be configured in a state in which the drum 30 is completely received therein by the coupling of the plurality of divided components.

Each of the plurality of components forming the outer appearance of the tub 100 may define a portion of the washing space 103.

For example, an overall outer appearance of the tub 100 may formed by coupling of the first case 300 and the second case 400.

The first case 300 and the second case 400, which are plastic materials, may be injection-molded and provided. The first case 300 and the second case 400 may be coupled to each other by a welding process to form the outer shape of the tub 100. In this connection, as the welding process, a welding method for generating vibrations in the first case 300 and the second case 400 may be applied.

The first case 300 may form approximately half of the tub 100 in the cylindrical shape. Further, the second case 400 may form the other half of the tub 100 in the cylindrical shape.

Referring to FIG. 1, it may be understood that the first case 300 forms a front portion of the tub 100 located close to the front face of the main body 10. Accordingly, the first case 300 may be referred to as a 'front case'.

It may be understood that the second case 400 forms a rear portion of the tub 100 located close to the rear face of the main body 10. Accordingly, the second case 400 may be referred to as a 'rear case'.

The first case 300 may be formed in a substantially cylindrical shape so as to define a portion of the washing space 103. In this connection, the first case 300 may be formed in a cylindrical shape with opened front and rear faces.

That is, a front face of the first case 300 may be opened such that the laundry may be inserted therein and removed therefrom. A rear face of the first case 300 may also be opened such that an internal space of the first case 300 is in communication with an internal space of the second case 400.

A front portion of the washing space 103 may be defined by the internal space of the first case 300.

The second case 400 may be formed in a substantially cylindrical shape so as to define the remaining portion of the washing space 103.

In this connection, the second case 400 may be formed in a cylindrical shape with an opened front face. That is, a front face of the second case 400 may be opened such that the internal space of the second case 400 is in communication with the internal space of the first case 300.

A rear portion of the washing space 103 may be defined by the internal space of the second case 400.

A shaft through-hole 401 through which the rotation shaft of the motor 40 passes may be defined in the rear face of the second case 400.

Faces of the first case 300 and the second case 400 facing each other may be formed in a shape corresponding to each other. For example, the rear face of the first case 300 and the front face of the second case 400 may be formed in a ring shape having a size corresponding to each other.

Thus, the first case 300 and the second case 400 may form the outer appearance of the tub 100 by coupling of the faces facing each other, thereby defining the washing space 103 of the tub 100.

The drum 30 may be inserted into an internal space of the first case 300 and the second case 400 in a state in which the first case 300 and the second case 400 are separated from each other. The drum 30 may be coupled to the rotation shaft of the motor 40 passing through the shaft through-hole 401 of the second case 400.

The drum 30 may be rotatably received in the washing space 103 by the coupling of the first case 300 and the second case 400.

In one example, the faces of the first case 300 and the second case 400 facing each other should be coupled with each other in an airtight manner such that leakage does not occur in the tub 100.

To this end, coupling surfaces extending vertically outwards may be respectively formed on the faces of the first case 300 and the second case 400 that face each other.

In detail, a first coupling surface 310 extending vertically outwards along an outer circumference of the first case 300 may be formed on the rear face of the first case 300. That is, the first coupling surface 310 extending vertically outwards along a circumference of the rear face may be formed on the rear face of the first case 300.

A second coupling surface 410 extending vertically outwards along an outer circumference of the second case 400 may be formed on the front face of the second case 400. That is, the second coupling surface 410 extending vertically outwards along a circumference of the front face may be formed on the front face of the second case 400.

The first coupling surface 310 and the second coupling surface 410 may be formed to have a shape and area corresponding to each other.

The coupling surface 310 and the second coupling surface 410 may be bonded to each other by the welding process in an airtight manner.

Hereinafter, with reference to the drawings, structures and a coupling structure of the first case 300 and the second case 400 will be described in more detail.

Figure 4:
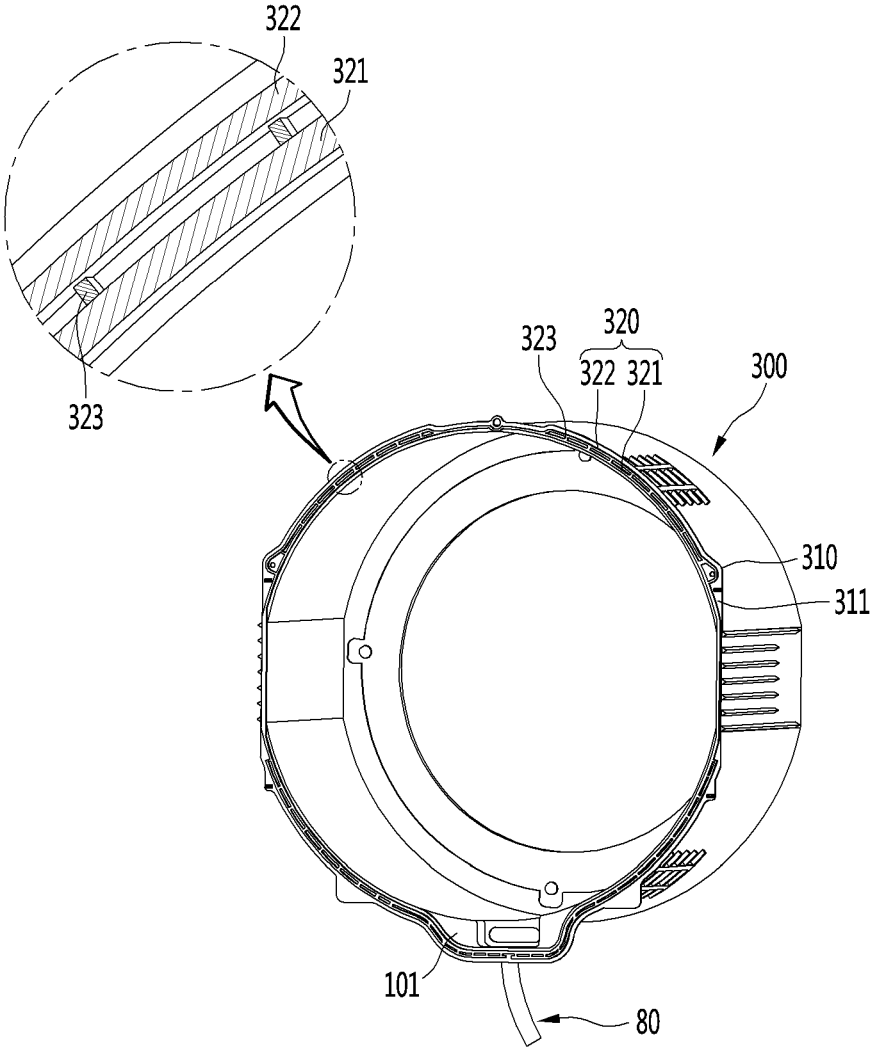
FIG. 4 is a rear perspective view of a first case according to an embodiment of the present disclosure.
Figure 5:
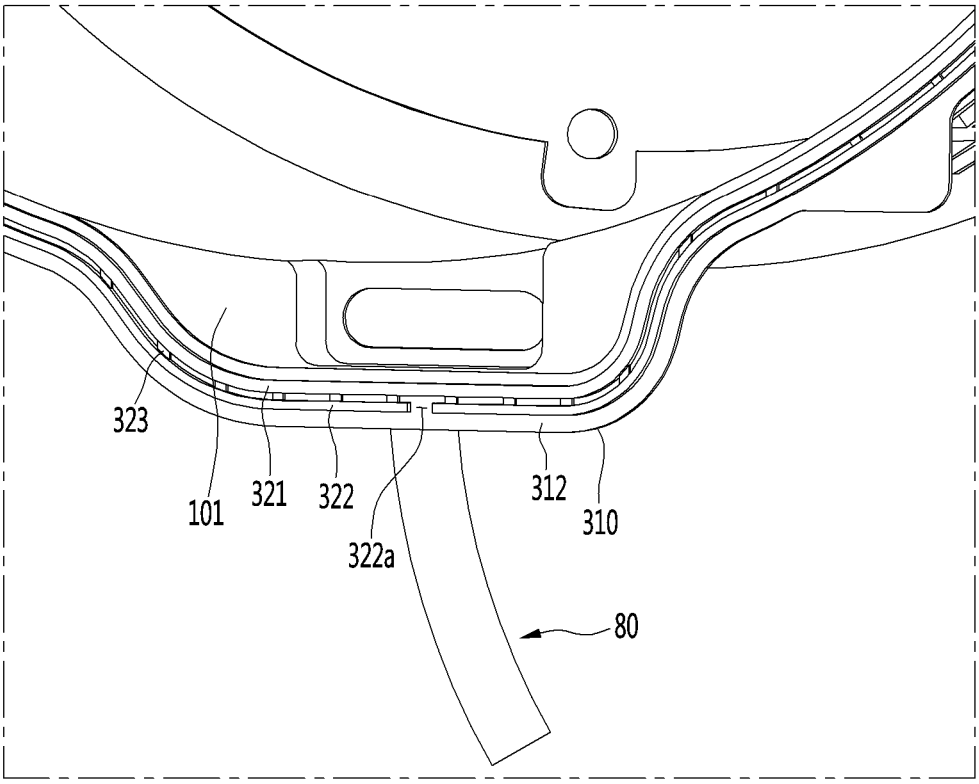
FIG. 5 is an enlarged view of a lower portion of a first case according to an embodiment of the present disclosure.

FIG. 4 is a rear perspective view of a first case according to an embodiment of the present disclosure. FIG. 5 is an enlarged view of a lower portion of a first case according to an embodiment of the present disclosure.

The first coupling surface 310 may be formed on the rear face of the first case 300.

A coupling protrusion 320 may be formed on the first coupling surface 310.

The coupling protrusion 320 may protrude rearward from the rear face of the first case 300. That is, the coupling protrusion 320 may protrude perpendicularly from the first coupling surface 310.

The coupling protrusion 320 may be formed along the first coupling surface 310 and may be formed on an entirety of a circumference of the rear face of the first case 300.

In detail, the coupling protrusion 320 may include a main coupling protrusion 321 and an auxiliary coupling protrusion 322.

The main coupling protrusion 321 may be formed to be radially thicker than the auxiliary coupling protrusion 322.

The main coupling protrusion 321 may be formed along the first coupling surface 310 and may be formed on an entirety of the circumference of the rear face of the first case 300. That is, the main coupling protrusion 321 may have a closed ring structure formed along the circumference of the first coupling surface 310.

The auxiliary coupling protrusion 322 may be formed along the first coupling surface 310. In this connection, the auxiliary coupling protrusion 322 may be located outward of the main coupling protrusion 321 on the first coupling surface 310. Further, the auxiliary coupling protrusion 322 may be spaced outward from the main coupling protrusion 321.

In one example, the main coupling protrusion 321 is located inward than the auxiliary coupling protrusion 322 but located slightly spaced outward from an inner end of the first coupling surface 310. That is, the main coupling protrusion 321 may be located between the auxiliary coupling protrusion 322 and the inner end of the first coupling surface 310.

The auxiliary coupling protrusion 322 is located outward than the main coupling protrusion 321 but located slightly spaced inward from an outer end of the first coupling surface 310. That is, the auxiliary coupling protrusion 322 may be located between the outer end of the first coupling surface 310 and the main coupling protrusion 321.

In one example, the first coupling surface 310 is formed along an entirety of the circumference of the rear face of the first case 300 but a width thereof extending outward may be different depending on a formation position. That is, it may be seen that an area of the first coupling surface 310 is different depending on the formation position.

The auxiliary coupling protrusion 322 may be formed only on a portion of the first coupling surface 310.

That is, the main coupling protrusion 321 may be formed on the entirety of the outer circumference of the first coupling surface 310 to encircle the washing space 103, and the auxiliary coupling protrusion 322 may be formed only on a portion of the outer circumference the first coupling surface 310.

In this connection, the auxiliary coupling protrusion 322 may be formed only on a portion of the first coupling surface 310 with a relatively large area.

In detail, in general, a height of the drum washing machine 1 may be greater than a width thereof.

That is, a vertical height of the cabinet 11 may be greater than a lateral width thereof. Therefore, a space with a vertical height greater than a lateral width thereof may be secured inside the cabinet 11.

Therefore, a space in which the water supply pipe 16 extends and a space in which the spring 19 is disposed may be secured above the tub 100 and inside the cabinet 11. In addition, a space in which components of the drain pump 17, the water discharge pipe 18, and the like are arranged may be secured below the tub 100 and inside the cabinet 11.

As the internal space of the cabinet 11 is formed such that the vertical height thereof is greater than the lateral width thereof, an available space with a vertical height greater than a lateral width thereof may be further secured inside the cabinet 11.

The tub 100 may be formed to have a lateral width corresponding to the lateral width of the internal space of the cabinet 11 so as to make the best use of the internal space of the cabinet 11. That is, a diameter of a cross section of the tub 100 may be formed to have a length substantially close to the lateral width of the internal space of the cabinet 11.

Therefore, the washing space 103 of the tub 100 may be secured to the maximum, and a washing capacity may be effectively secured by securing a maximum size of the drum 30.

However, as the lateral width of the available space in the tub 100 inside the cabinet 11 is less than the vertical height thereof, the first coupling surface 310 and the second coupling surface 410 may be limited in length extending outward from left and right sides of the tub 100.

Accordingly, the first coupling surface 310 and the second coupling surface 410 may have a length of portions thereof protruding from the left and right sides of the tub 100 less than a length of other portions. That is, the first coupling surface 310 and the second coupling surface 410 may have a relatively small width of the portions protruding from the left and right sides of the tub 100.

In this connection, the first coupling surface 310 and the second coupling surface 410 may have ends thereof protruding from the left and right sides of the tub 100 in a form of a straight-line corresponding to left and right inner faces of the cabinet 11. That is, straight portions 311 and 411 having outer ends thereof in a straight-line form may be formed at the left and right sides of the first coupling surface 310 and the second coupling surface 410.

In one example, as the straight portion 311 formed on left and right sides of the first case 300 has a relatively small width, it may be difficult to secure an area for forming the main coupling protrusion 321 and the auxiliary coupling protrusion 322 together.

Therefore, only the main coupling protrusion 321 may be formed on the straight portion 311 formed at the left and right sides of the first case 300.

In one example, a predetermined space may be defined inside the cabinet 10 and above the tub 100. Various auxiliary apparatuses 50 to assist in the washing or drying the laundry may be further arranged in the space above the tub 100.

For example, an opening through which air is flowed into or discharged from the tub 100 may be further defined in a top face of the tub 100. The auxiliary apparatus 50 may be a duct for drying or heating the air flowed into the tub 100.

Alternatively, the auxiliary apparatus 50 may be a heater that is connected to a water supply plate 16 passing through the space above the tub 100 and heats the washing water supplied into the tub 100.

In order to prevent interference with the auxiliary apparatus 50, the first coupling surface 310 and the second coupling surface 410 may be limited in length extending upwardly of the tub 100.

Therefore, the first coupling surface 310 formed on an upper side of the first case 300, and the second coupling surface 410 formed on an upper side of the second case 400 may have a relatively small width.

Therefore, only the main coupling protrusion 321 may be formed on the first coupling surface 310 formed on the upper side of the first case 300.

It may be seen that the auxiliary coupling protrusion 322 is formed on the remaining portions of the first coupling surface 310 except for a portion of the first coupling surface 310 formed on the upper side of the case 300 and portions of the first coupling surface 310 formed on the left and right sides of the first case 300.

That is, when viewing the rear face of the first case 300 straight, the auxiliary coupling protrusion 322 may be formed in a shape encircling the entire circumference of the lower portion of the first case 300 and encircling left and right regions except for a middle region of the circumference of the upper portion of the first case 300.

It may be seen that the auxiliary coupling protrusion 322 is broken in response to the reduction of the width of the first coupling surface 310 at the left and right sides and the upper side of the first case 300.

The broken end of the auxiliary coupling protrusion 322 may extend toward an adjacent main coupling protrusion 321 and may be connected to the main coupling protrusion 321. Alternatively, the broken end of the auxiliary coupling protrusion 322 may be connected to the main coupling protrusion 321 by a connection rib 323 to be described later.

In one example, the connection rib 323 may be further provided in a portion in which the main coupling protrusion 321 and the auxiliary coupling protrusion 322 are formed together on the first coupling surface 310.

The connection rib 323 may protrude in a space between the main coupling protrusion 321 and the auxiliary coupling protrusion 322 spaced apart from each other. The connection rib 323 may be formed to connect the main coupling protrusion 321 and the auxiliary coupling protrusion 322 with each other.

The connection rib 323 may include a plurality of connection ribs 323 spaced apart from each other in the space between the main coupling protrusion 321 and the auxiliary coupling protrusion 322.

In this connection, the plurality of connection ribs 323 may be spaced apart from each other along the circumference of the rear face of the case 300.

The main coupling protrusion 321 and the auxiliary coupling protrusion 322 may be supported by each other by the connection rib 323, so that strengths of the main and auxiliary coupling protrusions 321 and 322 may be reinforced. Therefore, when an external impact is applied or in the welding process, the main coupling protrusion 321 and the auxiliary coupling protrusion 322 may be prevented from being folded or broken.

In one example, a lower portion of the washing space 103, which is where the washing water is collected, may require more stable welding of the first case 300 and the second case 400 to prevent the leakage.

To this end, a distance between the plurality of connection ribs 323 may be reduced, so that the plurality of connection ribs 323 may be more densely arranged at the lower portion of the first case 300.

Therefore, strengths of the main coupling protrusion 321 and the auxiliary coupling protrusion 322 at the lower side of the first case 300 may become higher. Accordingly, when the first case 300 and the second case 400 are welded with each other, the main coupling protrusion 321 and the auxiliary coupling protrusion 322 at the lower side of the first case 300 are more stably welded with each other.

In one example, the main coupling protrusion 321 and the auxiliary coupling protrusion 322 may protrude by heights corresponding to each other. Accordingly, the main coupling protrusion 321 and the auxiliary coupling protrusion 322 may be welded at the same time.

In one example, the connection rib 323 may protrude by a height less than that of the main coupling protrusion 321 and the auxiliary coupling protrusion 322. In more detail, the connection rib 323 may have a height less than that of the main coupling protrusion 321 and the auxiliary coupling protrusion 322 in a state where the welding is completed.

Accordingly, division of the space between the main coupling protrusion 321 and the auxiliary coupling protrusion 322 by the connection rib 323 may be prevented. That is, the space between the main coupling protrusion 321 and the auxiliary coupling protrusion 322 may be defined in communication.

In one example, a structure in which the connection rib 323 is not disposed may be achieved.

In one example, when the drum washing machine 1 for washing the laundry is operated, the washing water may be limited to be filled to a vertical level lower than an intermediate vertical level of the washing space 103.

For example, the washing water may be filled inside the washing space 103, but may be limited to be filled to a vertical level lower than that of the straight portion 311.

For example, the washing water may be limited in a supply amount to be filled to a vertical level equal to or below a height corresponding to a limiting level (H) of the washing water.

The main body 10 may further include a sensor for sensing an amount of the washing water supplied into the tub 100 or sensing a vertical level of the washing water filled in the tub 100. The controller may control the supply amount of the washing water by controlling a water supply valve 16*a* (see FIG. 1) provided on the water supply pipe 16.

In one example, when the space between the main coupling protrusion 321 and the auxiliary coupling protrusion 322 is blocked, it may be difficult to detect the leakage of the washing water resulted from poor welding, breakage, or the like of the main coupling protrusion 321.

That is, when the welding failure or breakage of the main coupling protrusion 321 occurs, although the washing water may leak into the space between the main coupling protrusion 321 and the auxiliary coupling protrusion 322, it may be difficult to grasp such a problem viewed from the outside.

When a situation in which the washing water leaks into the space between the main coupling protrusion 321 and the auxiliary coupling protrusion 322 is maintained, the main coupling protrusion 321 may be more damaged as the drum washing machine 1 continues to be used. When the situation leads to the breakage of the auxiliary coupling protrusion 322, the washing water may lead to more serious problems, such as failure of the electric parts.

When the washing water leaked into the space between the main coupling protrusion 321 and the auxiliary coupling protrusion 322 is not discharged therefrom and is accumulated therein, hygiene issues such as an occurrence of mold may occur, and contamination of the laundry may occur.

Further, in order to prevent the above-mentioned problem, a discharge opening 322*a* for communicating the space between the main coupling protrusion 321 and the auxiliary coupling protrusion 322 to the outside may be defined at one side of the tub 100 according to an embodiment of the present disclosure.

The discharge opening 322*a* may be defined at a lower portion of the tub 100 and may be defined at a position vertically lower than the limiting level (H).

A welding quality of the coupling protrusion 320 encircling the region where the washing water is filled in the tub 100 may be seen as the most important.

As the discharge opening 322*a* is defined at the position vertically lower than the limiting level (H), the washing water leaked into the space between the main coupling protrusion 321 and the auxiliary coupling protrusion 322 may be effectively discharged to the outside.

As an example, one side of the auxiliary coupling protrusion 322 may be outwardly opened to define the opening 322*a*. That is, a portion of the auxiliary coupling protrusion 322 located at the bottom of the tub 100 may be cut to define the opening 322*a*.

Referring to FIG. 5, the discharge opening 322*a* may be defined at one side of the auxiliary coupling protrusion 322 located at the bottom of the tub 100. In this connection, it may be seen that the discharge opening 322*a* is defined in the auxiliary coupling protrusion 322 located at a central portion of the bottom of the tub 100.

The space between the main coupling protrusion 321 and the auxiliary coupling protrusion 322 may be opened downward of the tub 100 through the opening 322*a*.

The washing water leaked into the space between the main coupling protrusion 321 and the auxiliary coupling protrusion 322 may be collected in the space between the main coupling protrusion 321 and the auxiliary coupling protrusion 322 defined at the bottom of the tub 100 by gravity.

In more detail, the water collecting portion 101 recessed downward may be formed in the lower portion of the tub 100. The discharge opening 322*a* may be defined at a central position of the auxiliary coupling protrusion 322 surrounding the water collecting portion 101. That is, the discharge opening 322*a* may be defined at the central position of the auxiliary coupling protrusion 322 positioned below the water collecting portion 101.

In this connection, the bottom of the tub 100 may be formed in a planar shape. As the bottom of the tub 100 at which a load of the washing water is concentrated is formed in the planar shape, the load may be distributed and a strength of the bottom of the tub 100 may become higher.

When the water collecting portion 101 is located at the bottom of the tub 100, a bottom face of the water collecting portion 101 may be formed in a planar shape.

The first coupling surface 310 may be formed in a straight-line shape in a widthwise direction of the water collecting portion 101 which is perpendicular to an axial direction of the tub 100 on the bottom face of the water collecting portion 101. That is, a lower-side straight portion 312 horizontal in the widthwise direction may be formed on the first coupling surface 310 positioned on the bottom face of the water collecting portion 101.

The main coupling protrusion 321 and the auxiliary coupling protrusion 322 may be formed on the lower-side straight portion 312 in a straight-line shape in the widthwise direction of the water collecting portion 101.

It may be seen that the discharge opening 322*a* is defined in the auxiliary coupling protrusion 322 positioned at a central portion of the lower-side straight portion 312.

The washing water leaked into the space between the main coupling protrusion 321 and the auxiliary coupling protrusion 322 may move downward and be discharged to the outside through the opening 322*a*. The washing water discharged through the discharge opening 322*a* may be collected into the base fan 13.

The discharged washing water may move along the inclined bottom surface of the base fan 13 to be in contact with the leakage detecting sensor 70 provided on the base fan 13. The leakage of the washing water may be detected by the leakage detecting sensor 70, and the controller may notify the user of the occurrence of the leakage through the output device.

In one example, the guide member 80 for guiding the washing water discharged through the discharge opening 322*a* to the leakage detecting sensor 70 may be further disposed.

The guide member 80 may be applied in a structure extending from the discharge opening 322*a* toward the leakage detecting sensor 70 so as to guide the washing water to the leakage detecting sensor 70. For example, the guide member 80 may be applied in a pipe structure extending from the discharge opening 322*a* to the leakage detecting sensor 70.

The guide member 80 is disposed, so that the position of the discharge opening 322*a* may vary more freely. That is, even when the electrical parts are located below the opening 322*a*, the discharged washing water may be guided to the guide member 80 and effectively guided to the leakage detecting sensor 70 without being in contact with the electric parts.

Further, the discharge opening 322*a* may be defined at various positions at which the washing water collected in the lower portion of the tub 100 may be discharged to the outside. For example, the position of the discharge opening 322*a* may be selected to avoid positions of the electric parts located below the tub 100. Therefore, a problem in which the electric parts are come into contact with the washing water and damaged when the washing water is discharged may be prevented. Alternatively, the position of the discharge opening 322*a* may be selected to minimize a problem of lowering of the strength of the tub 100.

Hereinafter, another embodiment of the position of the discharge opening 322*a* will be described with reference to the drawing.

Figure 6:
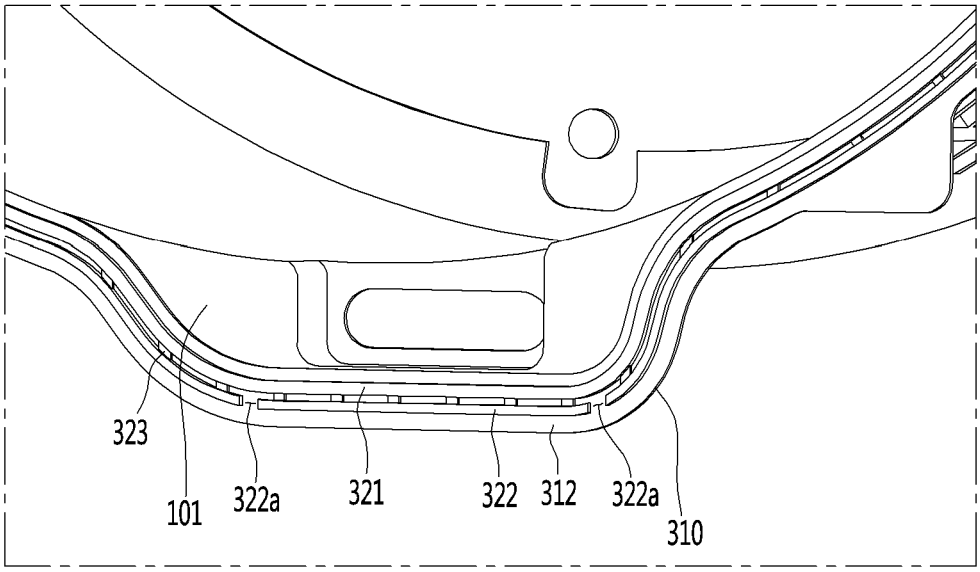
FIG. 6 shows a position of an opening according to another embodiment of the present disclosure.

FIG. 6 shows a position of a discharge opening according to another embodiment of the present disclosure.

Further, the auxiliary coupling protrusion 322 may have a relatively weak strength of a portion in which the discharge opening 322*a* is defined. The load of the washing water may be most concentrated at the central portion of the bottom of the tub 100.

Thus, when the discharge opening 322*a* is defined at the central portion of the bottom of the auxiliary coupling protrusion 322 where the load is most concentrated, problems may occur in the strength of the tub 100.

Correspondingly, the discharge opening 322*a* may be defined at the bottom of the tub 100, and may be defined at a position biased in the widthwise direction of the water collecting portion 101 from the central portion of the bottom. That is, the discharge opening 322*a* may be defined at one side of the auxiliary coupling protrusion 322 positioned at the bottom of the tub 100, and may be defined at a position biased in the widthwise direction of the water collecting portion 101 from a central position of the auxiliary coupling protrusion 322.

The discharge opening 322*a* may be opened in a diagonal direction to face downward and sideward at a position biased in the widthwise direction from the central position of the auxiliary coupling protrusion 322 at the bottom of the tub 100. In this connection, the discharge opening 322*a* may be defined in the auxiliary coupling protrusion 322 positioned at an end of the lower-side straight portion 312.

The discharge opening 322*a* may be defined at both left and right sides of the bottom of the auxiliary coupling protrusion 322, or may be defined at one of the left side and the right side.

In this connection, since the auxiliary coupling protrusion 322 located at the lower-side straight portion 312 is formed horizontally in the widthwise direction, even when the discharge opening 322*a* is defined at a position biased in the widthwise direction from the central portion of the bottom, the leaked washing water may be effectively discharged.

Hereinafter, still another embodiment of the position of the discharge opening 322*a* will be described with reference to the drawing.

Figure 7:
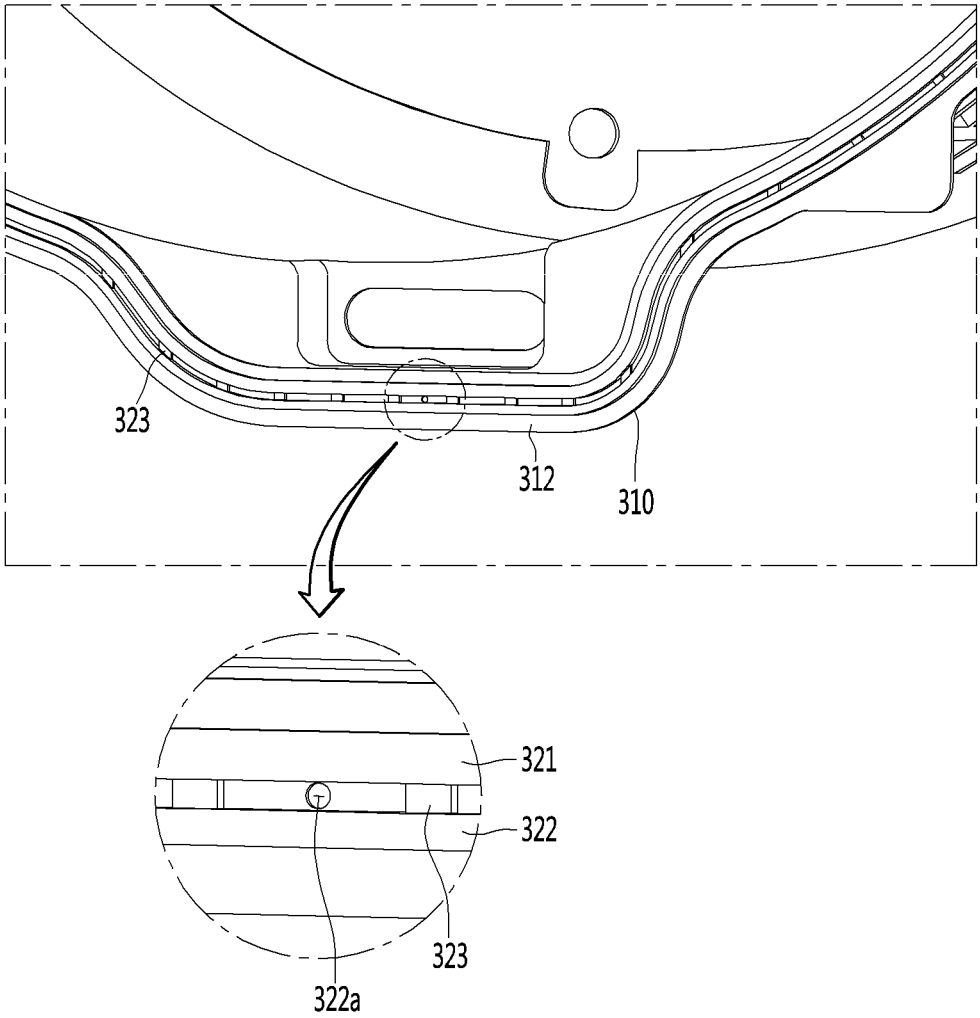
FIG. 7 shows a position of an opening according to still another embodiment of the present disclosure.

FIG. 7 shows a position of a discharge opening according to still another embodiment of the present disclosure.

The discharge opening 322*a* may be defined penetrating the coupling surface positioned between the main coupling protrusion 321 and the auxiliary coupling protrusion 322.

Since the discharge opening 322*a* is defined in the coupling surface instead of the coupling protrusion, the strength of the coupling protrusion may be prevented from being lowered.

For example, the discharge opening 322*a* may be defined in the first coupling surface 310 positioned between the main coupling protrusion 321 and the auxiliary coupling protrusion 322. Alternatively, the discharge opening 322*a* may be defined in the second coupling surface 410 positioned between the main coupling protrusion 321 and the auxiliary coupling protrusion 322.

In this connection, the discharge opening 322*a* may be defined penetrating the coupling surface located at the bottom of the tub 100, and may be located at the length-direction central position at the bottom of the tub 100.

In more detail, the water collecting portion 101 recessed downward may be formed in the lower portion of the tub 100. The discharge opening 322*a* may be defined in the coupling surface surrounding the water collecting portion 101.

When the discharge opening 322*a* is defined in the first coupling surface 310, the discharge opening 322*a* may be opened forward passing through the first coupling surface 310. When the discharge opening 322*a* is defined in the second coupling surface 410, the discharge opening 322*a* may be opened rearward passing through the second coupling surface 410.

In one example, the discharge opening 322*a* may be defined in both the first coupling surface 310 and the second coupling surface 410.

Figure 8:
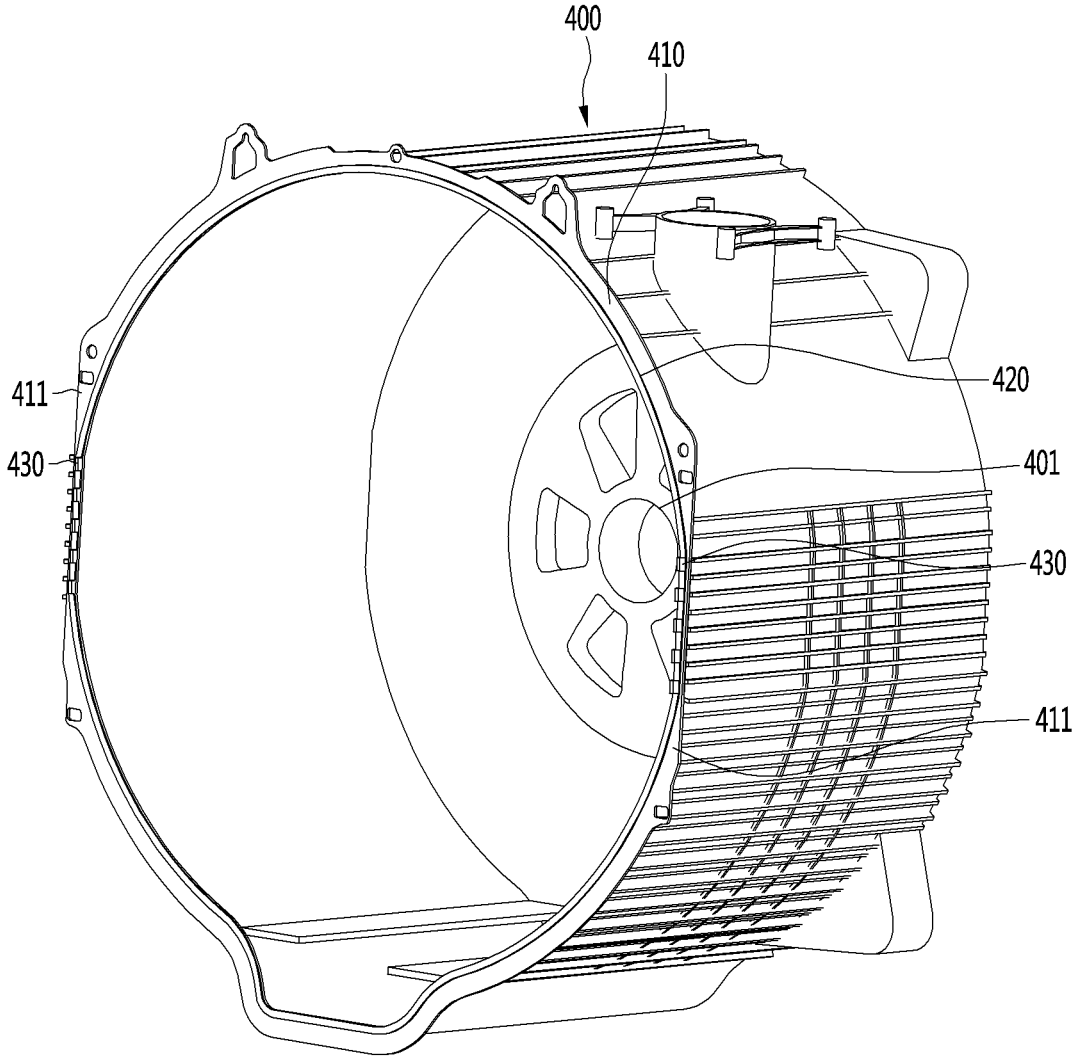
FIG. 8 is a front perspective view of a second case according to an embodiment of the present disclosure.
Figure 9:
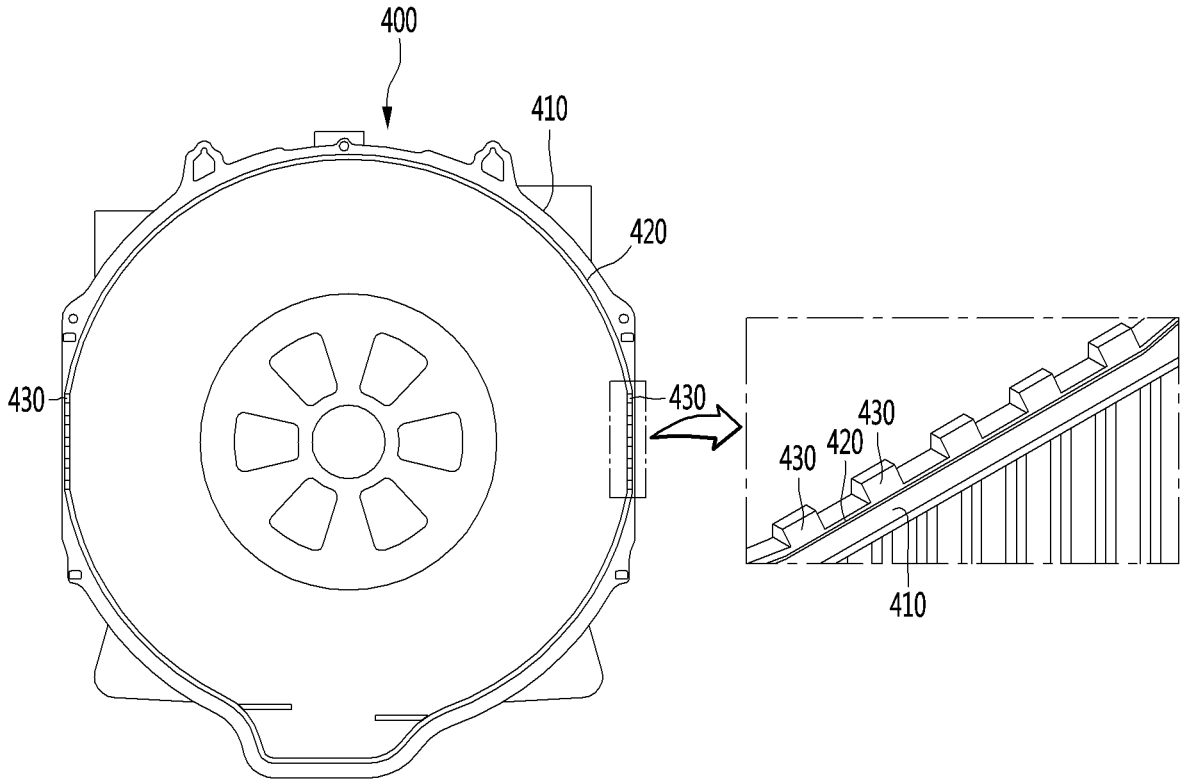
FIG. 9 is a front view of a second case according to an embodiment of the present disclosure.

FIG. 8 is a front perspective view of a second case according to an embodiment of the present disclosure. Further, FIG. 9 is a front view of a second case according to an embodiment of the present disclosure.

The second case 400 may be formed in the cylindrical shape with the open front face.

The through-hole 401 through which the rotation shaft of the motor 40 passes may be defined in the rear face of the second case 400.

The second coupling surface 410 may be formed on the front face of the second case 400.

The second coupling surface 410 may be formed to have a shape and an area corresponding to that of the first coupling surface 310.

The second coupling surface 410 may provide a face on which the main coupling protrusion 321 and the auxiliary coupling protrusion 322 are welded.

In detail, during the welding process of the first case 300 and the second case 400, the main coupling protrusion 321 and the auxiliary coupling protrusion 322 may be in contact with the second coupling surface 410. By vibration supplied from a welding apparatus 500 (see FIG. 11), the main coupling protrusion 321 and the auxiliary coupling protrusion 322 are melted by friction with the second coupling surface 410, and then welded to the second coupling surface 410.

In one example, a constraining protrusion 420 may be formed on the second coupling surface 410. The constraining protrusion 420 may be formed along the second coupling surface 410 to have a closed loop structure encircling the internal space of the second case 400.

The constraining protrusion 420 may provide a function of preventing flash F (see FIG. 11) generated when the coupling protrusion 320 is welded to the second coupling surface 410 from flowing into the tub 100. This will be described in more detail in a description referring to FIG. 11. For instance, the flash F may be a welding residue.

The constraining protrusion 420 may provide a function of reinforcing a strength of the second coupling surface 410.

The constraining protrusion 420 may be formed along a circumference of the front face of the second case 400 and may protrude forwards. That is, the constraining protrusion 420 may protrude vertically from the second coupling surface 410.

The constraining protrusion 420 may be formed to have a radial thickness less than the width of the second coupling surface 410. The constraining protrusion 420 may be formed along an inner end of the second coupling surface 410. Alternatively, the constraining protrusion 420 may be formed along the second coupling surface 410 at a position adjacent to the inner end of the second coupling surface 410. Therefore, an area in which the coupling protrusion 320 is welded to the second coupling surface 410 may be secured outward of the constraining protrusion 420.

In one example, a guide protrusion 430 may be further formed on the second coupling surface 410. The guide protrusion 430 may protrude forward from the second coupling surface 410.

The guide protrusion 430 may include a plurality of guide protrusions 430 radially arranged on the second coupling surface 410 around the internal space of the second case 400.

For example, the plurality of guide protrusions 430 may be located to face an outer circumference of the second coupling surface 410.

More specifically, the guide protrusions 430 may be formed on the second coupling surface 410 formed at the left and right sides of the second case 400. Alternatively, the guide protrusions 430 may be formed on the second coupling surface 410 formed at the upper and lower sides of the second case 400. As such, the guide protrusions 430 may be formed in regions of the second coupling surface 410 that are symmetric about the internal space of the second case 400.

Hereinafter, an example in which the guide protrusions 430 are formed on the second coupling surface 410 formed on the left and right sides of the second case 400 will be described.

The plurality of guide protrusions 430 may be arranged on the second coupling surface 410 of the left and right sides of the second case 400. In this connection, the plurality of guide protrusions 430 may be spaced apart from each other along the inner end of the second coupling surface 410 on the left and right sides.

The guide protrusion 430 may have a radial thickness less than the width of the second coupling surface 410. Therefore, an area in which the coupling protrusion 320 is welded to the second coupling surface 410 may be secured outward of the guide protrusion 430.

The guide protrusion 430 may have a slanted face declined outwardly of the second coupling surface 410. That is, a height of the guide protrusion 430 may be lowered outwardly of the second coupling surface 410.

In this connection, a vertical portion 431 may be formed at an outer end of the guide protrusion 430. The vertical portion 431 may be perpendicular to the second coupling surface 420.

The guide protrusion 430 may provide a function of guiding a position at which the first case 300 is coupled to the second case 400. The guide protrusion 430 may provide a function of reinforcing a coupling strength of the first case 300 and the second case 400 and preventing deformation of the tub 100.

In detail, when the first coupling surface 310 and the second coupling surface 410 are positioned to face each other for the welding of the first case 300 and the second case 400, the coupling protrusion 320 may be guided to a correct position of the second coupling surface 410 to be welded by the declination of the guide protrusion 430. That is, the coupling protrusion 320 may be guided to the second coupling surface 410 outward of the guide protrusion 430 by the declination of the guide protrusion 430.

An inner face of the coupling protrusion 320 is supported on the vertical portion 431 of the guide protrusion 430, so that the coupling protrusion 320 may be maintained at the correct position on the second coupling surface 410. Therefore, the coupling protrusion 320 may be stably welded at the correct position of the second coupling surface 410.

As the inner face of the coupling protrusion 320 is supported to the guide protrusion 430, the coupling strength of the tub 100 may be reinforced and the deformation of the tub 100 may be prevented.

In one example, the plurality of guide protrusions 430 spaced apart from each other may be connected with each other by the constraining protrusion 420. That is, both the constraining protrusions 420 and the guide protrusions 430 are arranged along the inner end of the second coupling surface 410, so that positions of the constraining protrusions 420 and the guide protrusions 430 may overlap. In this connection, the constraining protrusion 420 may be formed to connect the plurality of guide protrusions 430 with each other in a space between the plurality of guide protrusions 430.

The radial thickness of the constraining protrusion 420 may be less than that of the guide protrusion 430. The constraining protrusion 420 may be positioned such that an outer face thereof is connected to the vertical portion 431 of the guide protrusion 430.

Figure 10:
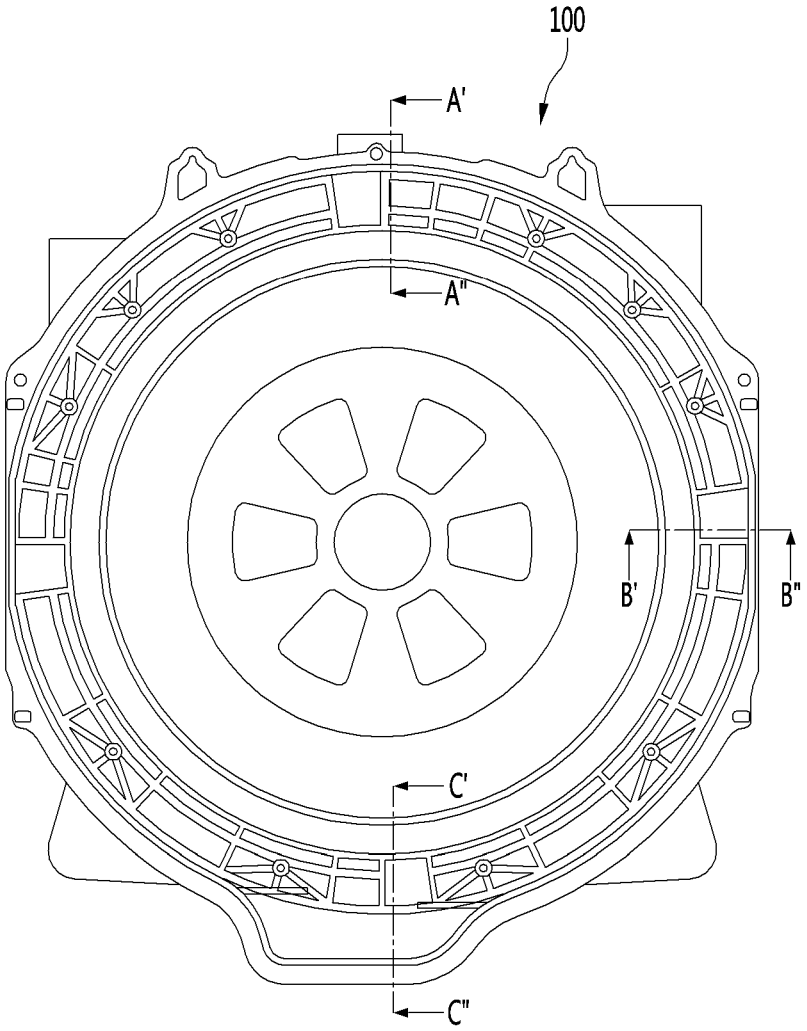
FIG. 10 is a rear view of a tub according to an embodiment of the present disclosure.

FIG. 10 is a rear view of a tub according to an embodiment of the present disclosure. Further, FIG. 11 is a view illustrating a welding structure of an upper portion of a tub by cutting the tub along an A'-A" line of FIG. 10.

Figure 11:
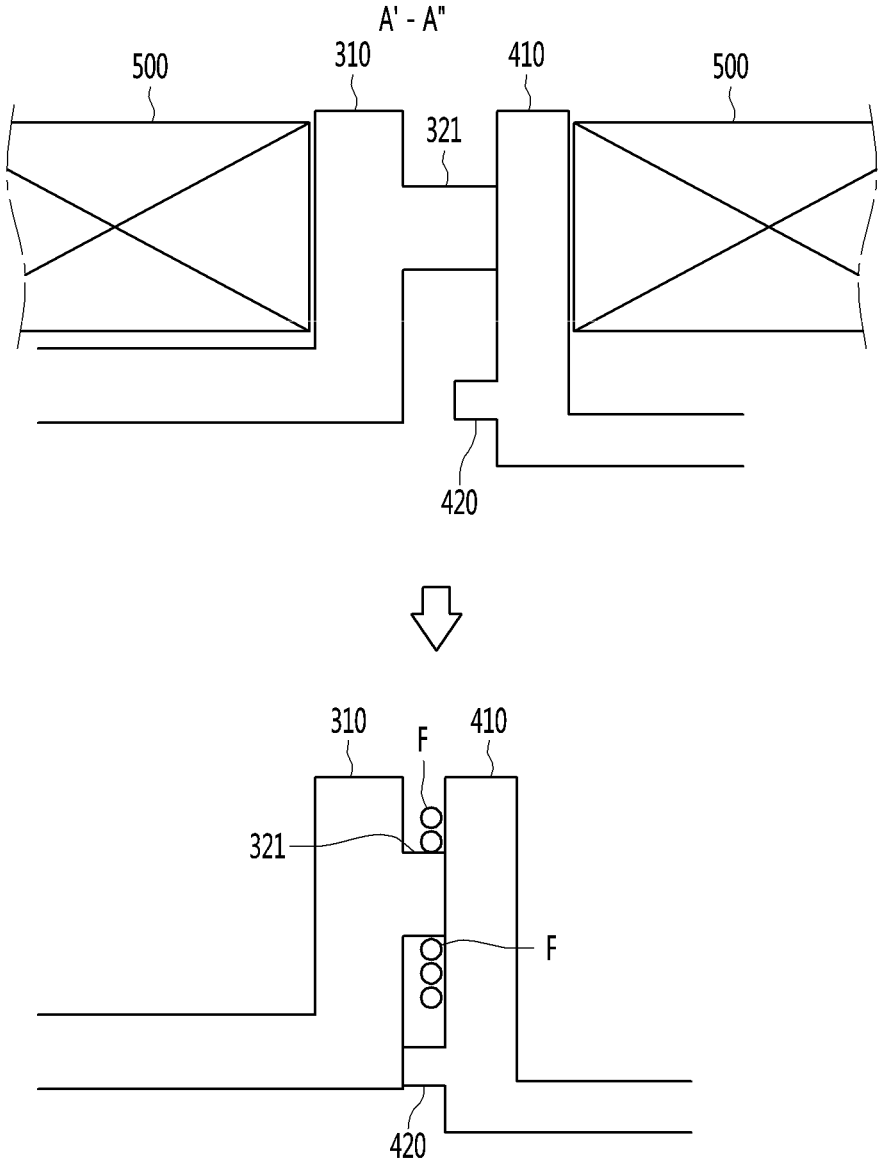
FIG. 11 is a view illustrating a welding structure of an upper portion of a tub by cutting the tub along an A'-A" line of FIG. 10.

The welding structure shown in FIG. 11 is not limited to a welding structure of the upper side of the tub 100. Further, it may be seen that the welding structure shown in FIG. 11 is a welding structure in which the main coupling protrusion 321 is formed on the first coupling surface 310 and the constraining protrusion 420 is formed on the second coupling surface 410.

Hereinafter, referring to FIG. 11, the welding structure in which the main coupling protrusion 321 is formed on the first coupling surface 310 and the constraining protrusion 420 is formed on the second coupling surface 410 will be described in detail.

As the coupling protrusion 320 is welded to the second coupling surface 410 by the welding process, the first coupling surface 310 and the second coupling surface 410 may be bonded to each other.

In this connection, a welding method for generating vibrations in the first case 300 and the second case 400 may be applied to the welding process.

For example, as the welding method for generating the vibrations, various welding methods such as an ultrasonic welding method, a vibration welding method, and the like may be applied.

The ultrasonic welding method is a welding method in which vertical vibrations are supplied to parts using an ultrasonic welding apparatus that generates ultrasonic waves, so that two parts in contact with each other are rubbed by the vibrations and welded to each other. The ultrasonic welding method is a well-known welding method, so that a detailed description of the ultrasonic welding method will be omitted.

The vibration welding method is a welding method in which horizontal vibrations are supplied to parts using a vibration apparatus that generates the vibration, so that two parts in contact with each other are rubbed by the vibration and welded to each other. The vibration welding method is a well-known welding method, so that a detailed description of the vibration welding method will be omitted.

For the welding, the first case 300 and the second case 400 may be aligned such that the first coupling surface 310 and the second coupling surface 410 face each other.

In a state in which the first coupling surface 310 and the second coupling surface 410 are aligned to face each other, a protruding end portion of the main coupling protrusion 321 may be in contact with the second coupling surface 410.

In a state in which the main coupling protrusion 321 is in contact with the second coupling surface 410, the welding apparatus 500 may be injected outward of the first coupling surface 310 and the second coupling surface 410 to pressurize from outward of the first coupling surface 310 and the second coupling surface 410. The protruding end portion of the main coupling protrusion 321 may come in close contact with the second coupling surface 410 by the injection of the welding apparatus 500.

In a state in which the main coupling protrusion 321 is in close contact with the second coupling surface 410, vibration may be supplied by the welding apparatus 500, and then frictional heat may be generated by the vibration at a contact portion between the main coupling protrusion 321 and the second coupling surface 410. The main coupling protrusion 321 may be melted and welded to the second coupling surface 410 by the frictional heat.

In one example, during the welding process, the flash F may occur in a process in which the coupling protrusion 320 is melted and then solidified again. The flash F is a lump of molten raw material of the coupling protrusion 320.

The flash F generated during the welding may be generated inward and outward of the coupling protrusion 320. The flash F generated outward of the coupling protrusion 320 may be discharged out of the tub 100 through the space between the first coupling surface 310 and the second coupling surface 410. In this connection, the flash F generated outward of the coupling protrusion 320 may be fossilized and remain in the space between the first coupling surface 310 and the second coupling surface 410. However, the flash F is blocked by the coupling protrusion 320 and is not flowed into the tub 100.

On the other hand, the flash F generated inward of the coupling protrusion 320 may be flowed into the tub 100 through the space between the first coupling surface 310 and the second coupling surface 410.

Therefore, a process for removing the flash F flowed into the tub 100 may be required, and as a result, producing time and costs of the tub 100 may be increased.

In addition, even when the process for removing the flash F flowed into the tub 100 is performed, the flash F may remain inside the tub 100. Alternatively, the flash F may remain between the first coupling surface 310 and the second coupling surface 410, and may be flowed into the tub 100 when the washing machine 1 that has been assembled is used. In this case, when the user uses the washing machine 1, the flash F may contaminate the laundry, thereby causing a great dissatisfaction of the user.

Therefore, a structure capable of preventing the flash F from flowing into the tub 100 is required.

In one example, in the embodiment of the present disclosure, the constraining protrusion 420 is disposed to effectively prevent the flash F from flowing into the tub 100.

In detail, when the first case 300 and the second case 400 are coupled to each other, the constraining protrusion 420 may be located inward of the coupling protrusion 320 or may be positioned to be spaced inwardly of the coupling protrusion 320.

That is, the constraining protrusion 420 may be located closer to the washing space 103 of the tub 100 than the main coupling protrusion 321 and the auxiliary coupling protrusion 322. Accordingly, a space in which the flash F is constrained may be secured between the coupling protrusion 320 and the constraining protrusion 420.

In this connection, the inner face of the constraining protrusion 420 may be located on the same extension line as a circumference of the internal space of the first case 300. Therefore, in the coupling of the first case 300 and the second case 400, the constraining protrusion 420 may not protrude into the washing space 103 of the tub 100, thereby preventing interference with flow of the washing water in the tub 100 or interference with the drum 30.

A protruding height of the constraining protrusion 420 may be less than that of the coupling protrusion 320.

For example, the constraining protrusion 420 may protrude to a height corresponding to a height of the coupling protrusion 320 lowered by the welding process. For example, the constraining protrusion 420 may protrude to a height equal to or less than the height of the coupling protrusion 320 melted by the welding process.

Therefore, in a state in which the welding coupling between the first case 300 and the second case 400 is completed, the protruding end portion of the constraining protrusion 420 may be adjacent to or in contact with the first coupling surface 310. Therefore, the flash F may be stably constrained in the space between the coupling protrusion 320, thereby effectively preventing the flash F from flowing into the tub 100.

That is, referring to FIG. 11, the flash F generated inward of the main coupling protrusion 321 is constrained in the space between the main coupling protrusion 321 and the constraining protrusion 420, so that the flash F does not flow into the tub 100.

In one example, the main coupling protrusion 321 may be located approximately at a width-direction center of the first coupling surface 310. Therefore, the vibration may be effectively transmitted to the main coupling protrusion 321 from the welding apparatus 500, so that the welding may be performed stably.

Figure 12:
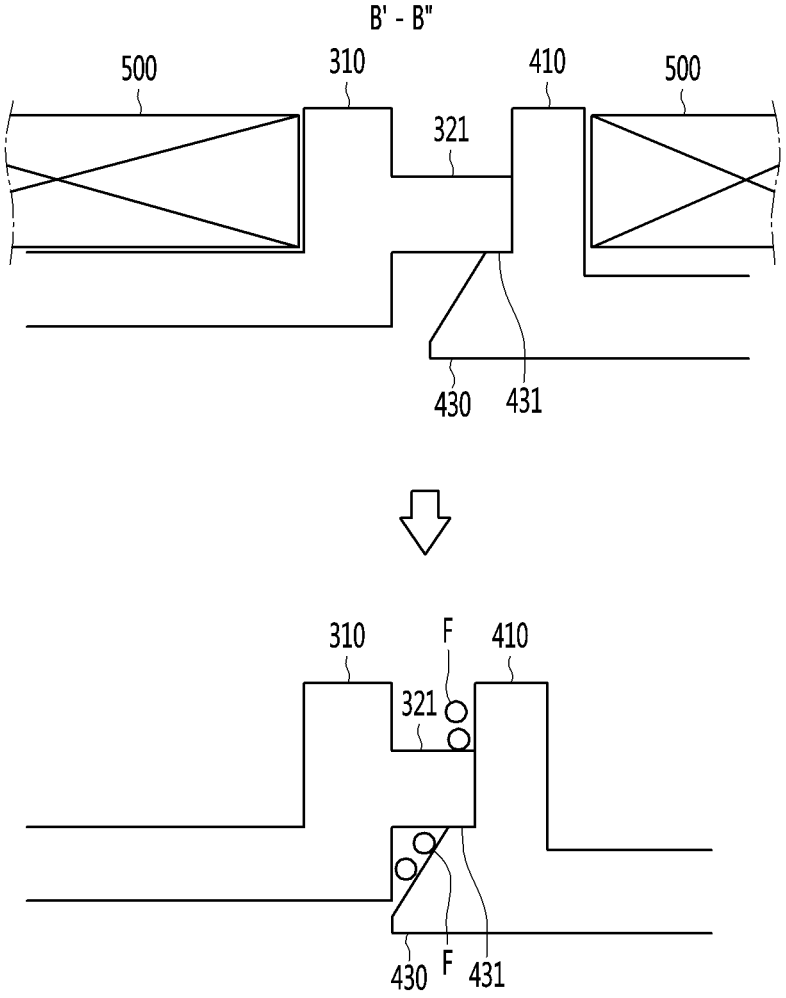
FIG. 12 is a view illustrating a welding structure of left and right portions of a tub by cutting the tub along a B'-B" line of FIG. 10.

FIG. 12 is a view illustrating a welding structure of left and right portions of a tub by cutting the tub along a B'-B" line of FIG. 10.

The welding structure shown in FIG. 12 is not limited to a welding structure of the left and right sides of the tub 100. Further, it may be seen that the welding structure shown in FIG. 12 is a welding structure in which only the main coupling protrusion 321 is formed on the first coupling surface 310 and the guide protrusion 430 and the constraining protrusion 420 are formed on the second coupling surface 410.

Hereinafter, referring to FIG. 11, the welding structure in which only the main coupling protrusion 321 is formed on the first coupling surface 310 and the guide protrusion 430 and the constraining protrusion 420 are formed on the second coupling surface 410 will be described in detail.

When the coupling protrusion 320 of the first coupling surface 310 is aligned to be in contact with the second coupling surface 410 for the welding, the coupling protrusion 320 may be guided to a correct position of the second coupling surface 410 by the inclination of the guide protrusion 430.

For example, when misalignment or deformation of the first coupling surface 310 and the second coupling surface 410 occurs, the main coupling protrusion 321 may come into contact with the slanted face of the guide protrusion 430. The main coupling protrusion 321 may be moved outward along the slanted face of the guide protrusion 430 and then be guided to the second coupling surface 410, which is to be welded, outward of the guide protrusion 430.

In a state in which the protruding end portion of the main coupling protrusion 321 is in contact with the second coupling surface 410, the inner face of the main coupling protrusion 321 may be in contact with the vertical portion 431 of the guide protrusion 430, thereby remaining at the correct welding position without moving inward or outward.

In one example, as the welding position of the coupling protrusion 320 is aligned and maintained in a region where the guide protrusion 430 is formed, the coupling protrusion 320 in a region where the guide protrusion 430 is not formed may also be aligned and maintained at the correct position of the second coupling surface 410 to be welded.

In one example, even in the region where the guide protrusion 430 is formed, the flash F to be generated during the welding may be generated inward and outward of the coupling protrusion 320.

The flash F generated outward of the main coupling protrusion 321 may be discharged out of the tub 100 through the space between the first coupling surface 310 and the second coupling surface 410.

The flash F generated inward of the main coupling protrusion 321 may be constrained in the space between the guide protrusion 430 and the main coupling protrusion 321. That is, the flash F may be prevented from flowing into the tub 100 by being constrained between the main coupling protrusion 321 and the slanted face of the guide protrusion 430.

To this end, the guide protrusion 430 may be have a height corresponding to a height of the coupling protrusion 320 lowered by the welding process. Therefore, in a state in which the welding coupling between the first case 300 and the second case 400 is completed, the protruding end portion of the guide protrusion 430 may be adjacent to or in contact with the first coupling surface 310.

Therefore, the flash F may be stably constrained in the space between the coupling protrusion 320, thereby effectively preventing the flash F from flowing into the tub 100.

Alternatively, the guide protrusion 430 may have a height greater than the height of the coupling protrusion 320 melted and lowered by the welding process.

In this case, in the state in which the welding coupling of the first case 300 and the second case 400 is completed, the guide protrusion 430 may be formed such that the slanted face thereof is adjacent to or in contact with the inner end of the first coupling surface 310.

In detail, the inner end, which is protruded to the maximum, of the guide protrusion 430 may be located inward than the circumference of the internal space of the first case 300. Therefore, in the state in which the welding coupling between the first case 300 and the second case 400 is completed, the slanted face of the guide protrusion 430 may be adjacent to or in contact with the inner end of the first coupling surface 310. Even in this case, the flash F may be stably constrained in the space between the coupling protrusion 320.

In one example, the main coupling protrusion 321 may be located approximately at a width-direction center of the first coupling surface 310. Therefore, the vibration may be effectively transmitted to the main coupling protrusion 321 from the welding apparatus 500, so that the welding may be performed stably.

Figure 13:
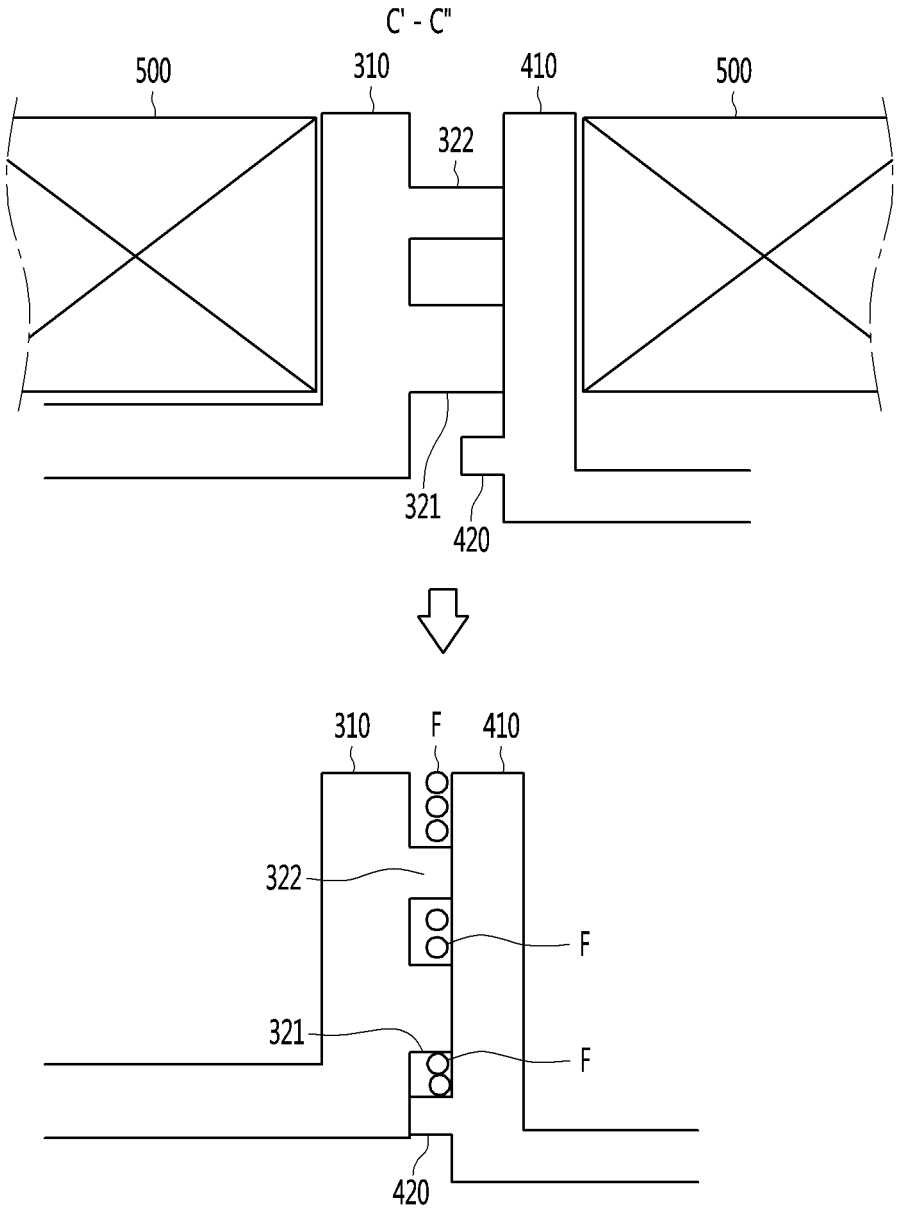
FIG. 13 is a view illustrating a welding structure of a lower portion of a tub by cutting the tub along a C'-C" line of FIG. 10.

FIG. 13 is a view illustrating a welding structure of a lower portion of a tub by cutting the tub along a C'-C" line of FIG. 10.

The welding structure shown in FIG. 13 is not limited to a welding structure of the lower side of the tub 100. Further, it may be seen that the welding structure shown in FIG. 13 is a welding structure in which both the main coupling protrusion 321 and the auxiliary coupling protrusion 322 are formed on the first coupling surface 310 and the constraining protrusion 420 is formed on the second coupling surface 410.

Hereinafter, referring to FIG. 13, the welding structure in which both the main coupling protrusion 321 and the auxiliary coupling protrusion 322 are formed together on the first coupling surface 310 and the constraining protrusion 420 is formed on the second coupling surface 410 will be described in detail.

The main coupling protrusion 321 may be approximately positioned at a width-direction center of the first coupling surface 310. Therefore, the vibration may be effectively transmitted to the main coupling protrusion 321 from the welding apparatus 500 and the welding may be stably performed even when the radial thickness of the main coupling protrusion 321 is greater than that of the auxiliary coupling protrusion 322.

The auxiliary coupling protrusion 322 may be located outward of the main coupling protrusion 321 and spaced apart from the main coupling protrusion 321. In this connection, the auxiliary coupling protrusion 322 may be located closer to the outer end than the inner end of the first coupling surface 310.

Thus, the auxiliary coupling protrusion 322 is positioned outward from the width-direction center of the first coupling surface 310, so that the vibration may not be stably transmitted from the welding apparatus 500 to the auxiliary coupling protrusion 322 than to the main coupling protrusion 321. However, since the radial thickness of the auxiliary coupling protrusion 322 is less than the radial thickness of the main coupling protrusion 321, the welding may be performed stably.

In one example, for the welding process, when the coupling protrusion 320 of the first coupling surface 310 is aligned to be in contact with the second coupling surface 410, the constraining protrusion 420 may be located inward of the main coupling protrusion 321 and may be positioned to be spaced inwardly from the main coupling protrusion 321.

That is, the constraining protrusion 420 may be located closer to the washing space 103 than the main coupling protrusion 321. Accordingly, a space in which the flash F is constrained may be secured between the main coupling protrusion 321 and the constraining protrusion 420.

In this connection, the inner face of the constraining protrusion 420 may be located on the same extension line as the circumference of the internal space of the first case 300. Therefore, the constraining protrusion 420 may not protrude into the washing space 103 when the first case 300 and the second case 400 are coupled to each other.

In one example, the flash F generated during the welding may be generated inward and outward of the main coupling protrusion 321, and inward and outward of the auxiliary coupling protrusion 322.

The flash F generated outward of the auxiliary coupling protrusion 322 may be discharged out of the tub 100 through the space between the first coupling surface 310 and the second coupling surface 410.

The flash F generated inward of the auxiliary coupling protrusion 322 and outward of the main coupling protrusion 322 may be constrained in the space between the main coupling protrusion 321 and the auxiliary coupling protrusion 322 and may not be flowed into the tub 100.

The flash F generated inward of the main coupling protrusion 321 may be constrained in the space between the main coupling protrusion 321 and the constraining protrusion 420 and may not be flowed into the tub 100.

That is, the flash F generated inward of the main coupling protrusion 321 may be prevented from being flowed into the tub 100 by the guide protrusion 430 in the region of the second coupling surface 410 in which the guide protrusion 430 is formed.

In one example, the coupling protrusion 320 is formed on the first coupling surface 310, and the constraining protrusion 420 and the guide protrusion 430 are formed on the second coupling surface 410 facing the first coupling surface 310, so that the flash F may be more effectively.

In detail, since the constraining protrusion 420 and the guide protrusion 430 are not be welded, in a state in which the coupling protrusion 320 is welded and shortened, the constraining protrusion 420 and the guide protrusion 430 are adjacent to or in contact with the first coupling surface 310 to block a passage through which the flash F flows into the tub 100.

That is, in a state in which the welding of the coupling protrusion 320 is not completed, a relatively large space may be generated between the first coupling surface 310 and the constraining protrusion 420 and between the first coupling surface 310 and the guide protrusion 430. In this connection, the relatively large space between the first coupling surface 310 and the constraining protrusion 420 and between the first coupling surface 310 and the guide protrusion 430 may have a size enough for the flash F to be flowed therein.

However, since an end of the coupling protrusion 320 in contact with the second coupling surface 410 is welded, the flash F is generated at the second coupling surface 410 side. That is, the flash F is accumulated from the second coupling surface 410 side in the space between the first coupling surface 310 and the second coupling surface 410.

In this connection, since the constraining protrusion 420 protrudes from the second coupling surface 410, the flash F accumulated from the second coupling surface 410 side may be effectively prevented from flowing into the tub 100.

That is, even though the relatively large space is generated between the first coupling surface 310 and the constraining protrusion 420 in a state in which welding of the coupling protrusion 320 is not completed, the flash F may be blocked by the constraining protrusion 420 protruding from the second coupling surface 410 and may not be flowed into the tub 100.

Similarly, since the guide protrusion 430 protrudes from the second coupling surface 410, the flash F accumulated from the second coupling surface 410 side may be effectively prevented from flowing into the tub 100.

That is, even though the relatively large space is generated between the first coupling surface 310 and the guide protrusion 430 in a state in which welding of the coupling protrusion 320 is not completed, the flash F may be blocked by the guide protrusion 430 protruding from the second coupling surface 410 and may not be flowed into the tub 100.

Further, in the embodiment of the present disclosure, it has been described that the coupling protrusion 320 is formed on the first case 300, and the constraining protrusion 420 and the guide protrusion 430 are formed on the second case 400. However, it is noted that the embodiment of the present disclosure is not limited thereto.

In detail, the constraining protrusion 420 and the guide protrusion 430 are formed on the first case 300, and the coupling protrusion 320 may be formed on the second case 400.

Further, in the embodiment of the present disclosure, it has been described that the constraining protrusion 420 is formed along the inner end of the second coupling surface 410 to be positioned inward of the coupling protrusion 320. However, the constraining protrusion 420 may be further formed outward of the coupling protrusion 320. That is, the constraining protrusion 420 may be further formed along the outer end of the second coupling surface 410. Therefore, the flash F may be prevented from being discharged out of the tub 100 through the space between the first coupling surface 310 and the second coupling surface 410.

Following effects may be expected in the tub of the washing machine and the washing machine including the same, according to the embodiment of the present disclosure.

First, in the coupling of the first case and the second case that form the tub with each other by the welding, the first coupling surface and the second coupling surface facing each other may be respectively formed on the first case and the second case. The first coupling surface includes the coupling protrusion for coupling the first case and the second case with each other by the welding process.

In this connection, the coupling protrusion includes the main coupling protrusion formed along the first coupling surface and the auxiliary coupling protrusion spaced outwardly from the main coupling protrusion. Therefore, as the main coupling protrusion and the auxiliary coupling protrusion are formed together, more firm welding coupling between the first case and the second case may be achieved. Further, the leakage of the water may be effectively prevented from occurring in the coupling portion of the first case and the second case.

Second, the opening for communicating the auxiliary coupling protrusion and the main coupling protrusion with the outside is defined in the bottom of the tub. Because of the opening, even when the leakage of the water occurs due to the poor welding of the main coupling protrusion or the damage to the main coupling protrusion, the washing water may be discharged to the outside without being constantly accumulated in the space between the main coupling protrusion and the auxiliary coupling protrusion. Therefore, the hygiene issues of the laundry resulted by the accumulation of the washing water may be prevented.

Third, the opening is defined at a position vertically lower than the limiting level (H) of the washing water filled in the washing space. Therefore, all of the washing water leaked between the main coupling protrusion and the auxiliary coupling protrusion may be immediately and effectively discharged to the outside.

Fourth, since the auxiliary coupling protrusion is formed to have a radial thickness less than that of the main coupling protrusion, even when the auxiliary coupling protrusion is formed together with the main coupling protrusion, the welding of the main coupling protrusion and the auxiliary coupling protrusion may be achieved stably.

Fifth, the plurality of connection ribs are formed to connect the main coupling protrusion and the auxiliary coupling protrusion with each other. Accordingly, the main coupling protrusion and the auxiliary coupling protrusion may be supported by each other by the plurality of connection ribs, thereby improving the strengths thereof. Therefore, the main coupling protrusion and the auxiliary coupling protrusion may be prevented from being folded or broken when the external impact is applied or in the welding process. In addition, as the strengths of the main coupling protrusion and the auxiliary coupling protrusion are reinforced, the first case and the second case may be more firmly coupled to each other.

In particular, as the connection rib is formed to have a height less than that of the coupling protrusion in a state where the welding is completed, the space between the main coupling protrusion and the auxiliary coupling protrusion may not be blocked by the connection rib and may be in communication with the opening. Therefore, when the washing water leaks into the space between the main coupling protrusion and the auxiliary coupling protrusion, the leaked washing water may be moved to the bottom of the tub and be effectively discharged to the outside through the opening.

Sixth, the first coupling surface extends outward of the circumference of the first case, and the second coupling surface extends outward of the circumference of the second case. Therefore, an area in which the welding apparatus is contact with and presses the first coupling surface and the second coupling surface from outward thereof may be secured.

Seventh, in the state in which the first coupling surface and the second coupling surface are bonded to each other, the constraining protrusion located inward of the coupling protrusion protrudes from the second coupling surface. Therefore, the flash generated when the coupling protrusion is welded may be prevented from flowing into the washing space.

In this connection, the constraining protrusion is formed on the second coupling surface facing the first coupling surface where the coupling protrusion is formed, so that the flash may be effectively prevented from flowing into the washing space during the welding of the coupling protrusion.

That is, an end of the coupling protrusion in contact with the second coupling surface is melted, so that the flash is generated on the second coupling surface side and is accumulated from the second coupling surface side in the space between the first coupling surface and the second coupling surface. In this connection, the constraining protrusion is formed to protrude from the second coupling surface, so that the flash accumulated from the second coupling surface side may be effectively prevented from flowing into the tub.

Eighth, the guide protrusion for guiding the coupling protrusion to the coupling surface outward of the constraining protrusion is formed on the second coupling surface, and the guide protrusions are formed at both sides of the second coupling surface facing each other around the internal space of the second case. In addition, the guide protrusion has a slanted face declined downwards.

Therefore, the coupling protrusion may be accurately guided to the second coupling surface outward of the constraining protrusion to be welded by the slanted face of the guide protrusion. That is, the coupling protrusion is guided to the correct position of the second coupling surface by the guide protrusion, so that stable welding may be achieved.

Ninth, the base forming the bottom face of the cabinet has the leakage detecting sensor for detecting the leakage when in contact with the washing water, and the cabinet has the output device for outputting information. The controller is provided to output a notification through the output device when the leakage is detected.

Accordingly, when the washing water leaked through the opening is discharged, the discharged washing water may be collected in the base and come into contact with the leakage detecting sensor. Then, the controller may inform the user of the occurrence of the leakage through the output device. Thus, the user may cope with the leakage.

Tenth, there is provided the guide member extending from the opening toward the leakage detecting sensor to guide the washing water discharged through the opening to the leakage detecting sensor. As the guide member is provided, the washing water discharged from the opening may be prevented from contacting and damaging the electric parts arranged in the cabinet. That is, the washing water discharged from the opening may be reliably guided to the leakage detecting sensor, thereby preventing further failure due to the leakage.

What is claimed is:

1. A tub of a washing machine, the tub defining a washing space therein configured to receive washing water and accommodating a drum in the washing space, the tub comprising:

a first case and a second case that are welded to each other, each of the first case and the second case defining a portion of the washing space and a portion of an outer appearance of the tub;

a first coupling surface that extends along a circumference of the first case and that faces the second case;

a second coupling surface that extends along a circumference of the second case, that faces the first case, and that is coupled to the first coupling surface; and a coupling protrusion that protrudes from the first coupling surface toward the second coupling surface and that extends along the first coupling surface, the coupling protrusion comprising a protruding end portion welded to the second coupling surface, wherein the coupling protrusion comprises:

a main coupling protrusion that extends along the first coupling surface, and an auxiliary coupling protrusion disposed radially outward of the main coupling protrusion and spaced apart from the main coupling protrusion to thereby define a protrusion space between the auxiliary coupling protrusion and the main coupling protrusion, wherein the tub defines a discharge opening at a bottom portion of the tub, the discharge opening being in communication with the protrusion space and connected to an outside of the tub, wherein the bottom portion of the tub comprises a water collecting portion that is recessed downward from the first case or the second case and that is configured to collect washing water supplied into the tub, the water collecting portion comprising a bottom surface that has a planar shape, wherein a portion of the auxiliary coupling protrusion located at the bottom portion of the tub is cut to thereby define the discharge opening, and wherein the discharge opening is defined at (i) a central position of the auxiliary coupling protrusion disposed between widthwise ends of the bottom surface of the water collecting portion, or (ii) a position offset in a widthwise direction from the central position of the auxiliary coupling protrusion between the widthwise ends of the bottom surface of the water collecting portion.

2. The tub of claim 1, wherein the first coupling surface comprises a lower-side linear portion that is disposed at the water collecting portion, that extends along the bottom surface of the water collecting portion in the widthwise direction that is orthogonal to an axial direction extending through the first case and the second case, and wherein the main coupling protrusion and the auxiliary coupling protrusion are disposed on the lower-side linear portion and extend linearly along the widthwise direction.

3. The tub of claim 1, wherein the bottom surface of the water collecting portion extends in the widthwise direction between the widthwise ends, the widthwise direction being orthogonal to an axial direction extending through the first case and the second case.

4. The tub of claim 1, wherein one of the first case or the second case defines a front portion of the tub, and the other of the first case or the second case defines a rear portion of the tub, wherein the first coupling surface extends radially outward from the circumference of the first case, and wherein the second coupling surface extends radially outward from the circumference of the second case.

5. The tub of claim 4, further comprising:

a constraining protrusion that protrudes from the second coupling surface to the first coupling surface, that extends along the second coupling surface, and that is configured to limit a spread of a welding residue generated during welding of the coupling protrusion within a gap between the first coupling surface and the second coupling surface, wherein the constraining protrusion is disposed in at least one of (i) a first region of the second coupling surface located radially inward of the main coupling protrusion or (ii) a second region of the second coupling surface located radially outward of the auxiliary coupling protrusion.

6. The tub of claim 5, wherein the constraining protrusion is disposed in the first region of the second coupling surface, and is spaced apart from the main coupling protrusion.

7. The tub of claim 5, further comprising:

guide protrusions that are disposed on the second coupling surface, that are disposed at a first side and a second side of the tub, and that face each other with respect to the washing space, the guide protrusions being configured to guide the coupling protrusion to an area of the second coupling surface outside the constraining protrusion, wherein each of the guide protrusions defines a slanted surface that is inclined with respect to the second coupling surface, and wherein a distance between the slanted surface and the first coupling surface increases as the slanted surface extends radially outward.

8. The tub of claim 1, wherein the discharge opening passes through at least one of the first coupling surface or the second coupling surface, and is defined between the main coupling protrusion and the auxiliary coupling protrusion.

9. A washing machine comprising:

a cabinet that defines an inner space therein;

a tub that is disposed in the inner space of the cabinet and that defines a washing space configured to receive washing water; and a drum rotatably disposed in the tub and configured to receive laundry, wherein the tub comprises:

a first case and a second case that are welded to each other, each of the first case and the second case defining a portion of the washing space and a portion of an outer appearance of the tub, a first coupling surface that extends along a circumference of the first case and that faces the second case, a second coupling surface that extends along a circumference of the second case, that faces the first case, and that is coupled to the first coupling surface, and a coupling protrusion that protrudes from the first coupling surface toward the second coupling surface and that extends along the first coupling surface, the coupling protrusion comprising a protruding end portion welded to the second coupling surface, wherein the coupling protrusion comprises:

a main coupling protrusion that extends along the first coupling surface, and an auxiliary coupling protrusion disposed radially outward of the main coupling protrusion and spaced apart from the main coupling protrusion to thereby define a protrusion space between the auxiliary coupling protrusion and the main coupling protrusion, wherein the tub defines a discharge opening at a bottom portion of the tub, the discharge opening being in communication with the protrusion space and connected to an outside of the tub, wherein the bottom portion of the tub comprises a water collecting portion that is recessed downward from the first case or the second case and that is configured to collect washing water supplied into the tub, the water collecting portion comprising a bottom surface that has a planar shape, wherein a portion of the auxiliary coupling protrusion located at the bottom portion of the tub is cut to thereby define the discharge opening, and wherein the discharge opening is defined at (i) a central position of the auxiliary coupling protrusion disposed between widthwise ends of the bottom surface of the water collecting portion, or (ii) a position offset in a widthwise direction from the central position of the auxiliary coupling protrusion between the widthwise ends of the bottom surface of the water collecting portion.

10. The washing machine of claim 9, wherein the first coupling surface comprises a lower-side linear portion that is disposed at the water collecting portion, that extends along the bottom surface of the water collecting portion in the widthwise direction that is orthogonal to an axial direction extending through the first case and the second case, and wherein the main coupling protrusion and the auxiliary coupling protrusion are disposed on the lower-side linear portion and extend linearly along the widthwise direction.

11. The washing machine of claim 9, wherein the bottom surface of the water collecting portion extends in the widthwise direction between the widthwise ends, the widthwise direction being orthogonal to an axial direction extending through the first case and the second case.

12. The washing machine of claim 9, further comprising:

a base that defines a bottom surface of the cabinet; and a leakage detecting sensor disposed at the base and configured to detect water leakage based on contacting washing water discharged from the tub.

13. The washing machine of claim 12, further comprising:

a guide member that extends from the discharge opening toward the leakage detecting sensor and that is configured to guide washing water discharged through the discharge opening to the leakage detecting sensor.

14. The washing machine of claim 9, wherein the cabinet defines an entrance at a front surface of the cabinet, the entrance being configured to introduce laundry to the drum, wherein each of the tub and the drum defines an aperture configured to communicate with the entrance, and wherein the first case defines a front portion of the tub facing the entrance, and the second case defines a rear portion of the tub away from the entrance.

15. The washing machine of claim 14, wherein one of the first case or the second case defines a water drain hole that is spaced apart from the discharge opening in a front-rear direction and that is configured to discharge washing water to an outside of the cabinet.

16. A tub of a washing machine, the tub defining a washing space therein configured to receive washing water and accommodating a drum in the washing space, the tub comprising:

a first case and a second case that are welded to each other, each of the first case and the second case defining a portion of the washing space and a portion of an outer appearance of the tub;

a first coupling surface that extends along a circumference of the first case and that faces the second case;

a second coupling surface that extends along a circumference of the second case, that faces the first case, and that is coupled to the first coupling surface; and a coupling protrusion that protrudes from the first coupling surface toward the second coupling surface and that extends along the first coupling surface, the coupling protrusion comprising a protruding end portion welded to the second coupling surface, wherein the coupling protrusion comprises:

a main coupling protrusion that extends along the first coupling surface, and an auxiliary coupling protrusion disposed radially outward of the main coupling protrusion and spaced apart from the main coupling protrusion to thereby define a protrusion space between the auxiliary coupling protrusion and the main coupling protrusion, wherein the tub defines a discharge opening at a bottom portion of the tub, the discharge opening being in communication with the protrusion space and connected to an outside of the tub, wherein the bottom portion of the tub comprises a water collecting portion that is recessed downward from the first case or the second case and that is configured to collect washing water supplied into the tub, the water collecting portion comprising a bottom surface that has a planar shape, wherein a portion of the auxiliary coupling protrusion located at the bottom portion of the tub is cut to thereby define the discharge opening, and wherein the discharge opening is defined at a position of the auxiliary coupling protrusion between widthwise ends of the bottom surface of the water collecting portion.

17. The tub of claim 16, wherein the bottom surface of the water collecting portion extends in a widthwise direction between the widthwise ends, the widthwise direction being orthogonal to an axial direction extending through the first case and the second case.

18. The tub of claim 16, wherein the discharge opening is defined at a central position of the auxiliary coupling protrusion disposed between the widthwise ends of the bottom surface of the water collecting portion.

19. The tub of claim 16, wherein the discharge opening is defined at a position offset from a central position of the auxiliary coupling protrusion between the widthwise ends of the bottom surface of the water collecting portion.

* * * * *